US012104353B2

(12) United States Patent
Ito

(10) Patent No.: US 12,104,353 B2
(45) Date of Patent: Oct. 1, 2024

(54) EXCAVATOR AND CONTROL APPARATUS FOR EXCAVATOR

(71) Applicant: SUMITOMO HEAVY INDUSTRIES, LTD., Tokyo (JP)

(72) Inventor: Tsutomu Ito, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 584 days.

(21) Appl. No.: 17/319,296

(22) Filed: May 13, 2021

(65) Prior Publication Data

US 2021/0262196 A1 Aug. 26, 2021

Related U.S. Application Data

(63) Continuation of application No. PCT/JP2019/044785, filed on Nov. 14, 2019.

(30) Foreign Application Priority Data

Nov. 14, 2018 (JP) ..... 2018-214162

(51) Int. Cl.

| | |
|---|---|
| ***E02F 9/00*** | (2006.01) |
| ***E02F 3/32*** | (2006.01) |
| ***E02F 9/02*** | (2006.01) |
| ***E02F 9/12*** | (2006.01) |
| ***E02F 9/20*** | (2006.01) |

(Continued)

(52) U.S. Cl.

CPC ..... *E02F 9/2033* (2013.01); *E02F 3/32* (2013.01); *E02F 9/02* (2013.01); *E02F 9/123* (2013.01); *E02F 9/2004* (2013.01); *E02F 9/24* (2013.01); *E02F 9/261* (2013.01); *E02F 9/2221* (2013.01);

(Continued)

(58) Field of Classification Search

None

See application file for complete search history.

(56) References Cited

U.S. PATENT DOCUMENTS

| | | |
|---|---|---|
| 6,076,029 A | 6/2000 | Watanabe et al. |
| 6,098,322 A | 8/2000 | Tozawa et al. |

(Continued)

FOREIGN PATENT DOCUMENTS

| | | |
|---|---|---|
| EP | 3378996 | 9/2018 |
| JP | H10-259619 | 9/1998 |

(Continued)

OTHER PUBLICATIONS

JPO Machine Translation of JP2017-008719 (Year: 2017).*

International Search Report for PCT/JP2019/044785 mailed on Jan. 28, 2020.

*Primary Examiner* — James M McPherson

(74) *Attorney, Agent, or Firm* — IPUSA, PLLC

(57) ABSTRACT

An excavator includes a lower traveling body; an upper turning body turnably mounted to the lower traveling body; an actuator configured to change an orientation of the upper turning body; and a control apparatus configured to perform front-face control to operate the actuator such that the upper turning body is caused to front-face a target surface, based on information regarding the target surface and information regarding the orientation of the upper turning body, wherein the control apparatus performs the front-face control such that the upper turning body maintains a state of front-facing the target surface.

15 Claims, 18 Drawing Sheets

(51) Int. Cl.
*E02F 9/24* (2006.01)
*E02F 9/26* (2006.01)
*E02F 9/22* (2006.01)

(52) U.S. Cl.
CPC ..... *E02F 9/2285* (2013.01); *E02F 9/2292* (2013.01); *E02F 9/2296* (2013.01)

(56) References Cited

U.S. PATENT DOCUMENTS

| | | | | |
|---|---|---|---|---|
| 7,532,967 | B2 | 5/2009 | Fujishima et al. | |
| 9,624,648 | B2 | 4/2017 | Arimatsu et al. | |
| 9,650,755 | B2 | 5/2017 | Nomura et al. | |
| 10,565,690 | B2 | 2/2020 | Hiekata | |
| 10,687,026 | B2 | 6/2020 | Izumikawa et al. | |
| 2005/0131610 | A1 | 6/2005 | Sahm et al. | |
| 2007/0295551 | A1* | 12/2007 | Proud | B60K 26/02 180/333 |
| 2014/0174063 | A1* | 6/2014 | Gabibulayev | F15B 11/042 60/327 |
| 2016/0138249 | A1* | 5/2016 | Conway | E02F 9/24 701/50 |
| 2016/0251834 | A1* | 9/2016 | Arimatsu | E02F 3/435 414/687 |
| 2018/0274207 | A1 | 9/2018 | Yokoo et al. | |
| 2020/0048893 | A1* | 2/2020 | Martinez | E04B 1/3505 |
| 2021/0292998 | A1* | 9/2021 | Kawamoto | E02F 9/261 |

FOREIGN PATENT DOCUMENTS

| | | |
|---|---|---|
| JP | 2002-327465 | 11/2002 |
| JP | 2004-107926 | 4/2004 |
| JP | 2008-106440 | 5/2008 |
| JP | 2014-074319 | 4/2014 |
| JP | 2017-008719 | 1/2017 |
| WO | 98/036131 | 8/1998 |
| WO | 2015/173936 | 11/2015 |
| WO | 2017/026469 | 2/2017 |
| WO | 2017/150136 | 9/2017 |

* cited by examiner

EXCAVATOR AND CONTROL APPARATUS FOR EXCAVATOR

CROSS-REFERENCE TO RELATED APPLICATIONS

The present application is a continuation application of International Application No. PCT/JP2019/044785 filed on Nov. 14, 2019, which claims priority to Japanese Patent Application No. 2018-214162, filed on Nov. 14, 2018. The contents of these applications are incorporated herein by reference in their entirety.

BACKGROUND

1. Technical Field

The present invention relates to an excavator and the like.

2. Description of the Related Art

For example, a technique is known in which an operator or the like is able to recognize whether the upper turning body of the excavator is front-facing the target work surface, such as a slope.

SUMMARY

According to an embodiment of the present invention, there is provided an excavator including a lower traveling body; an upper turning body turnably mounted to the lower traveling body; an actuator configured to change an orientation of the upper turning body; and a control apparatus configured to perform front-face control to operate the actuator such that the upper turning body is caused to front-face a target surface, based on information regarding the target surface and information regarding the orientation of the upper turning body, wherein the control apparatus performs the front-face control such that the upper turning body maintains a state of front-facing the target surface.

Further, in another embodiment of the present invention, there is provided an excavator including a lower traveling body; an upper turning body turnably mounted to the lower traveling body; an attachment to be attached to the upper turning body; an actuator configured to change an orientation of the upper turning body; and a control apparatus configured to perform front-face control to operate the actuator such that the upper turning body is caused to front-face a target surface, based on information regarding the target surface and information regarding the orientation of the upper turning body, wherein the control apparatus starts performing the front-face control when the upper turning body is operated to turn in a direction such that the attachment comes near the target surface.

Further, in yet another embodiment of the present invention, there is provided a control apparatus of an excavator, the excavator including a lower traveling body; an upper turning body turnably mounted to the lower traveling body; and an actuator configured to change an orientation of the upper turning body, wherein the control apparatus is configured to perform front-face control to operate the actuator such that the upper turning body is caused to front-face a target surface, based on information regarding the target surface and information regarding the orientation of the upper turning body, and to perform the front-face control such that the upper turning body maintains a state of front-facing the target surface.

Further, in yet another embodiment of the present invention, there is disclosed a control apparatus of an excavator, the excavator including a lower traveling body; an upper turning body turnably mounted to the lower traveling body; an attachment to be attached to the upper turning body; and an actuator configured to change an orientation of the upper turning body, wherein the control apparatus is configured to perform front-face control to operate the actuator such that the upper turning body is caused to front-face a target surface, based on information regarding the target surface and information regarding the orientation of the upper turning body, and to start performing the front-face control when the upper turning body is operated to turn in a direction such that the attachment comes near the target surface.

DETAILED DESCRIPTION

In the conventional technology, if the turning body is not front-facing the target work surface, the operator needs to perform a turning operation, or the like, in order to make the excavator front-face the target work surface. Therefore, the operator may feel burdened each time the operator performs an operation process for making the excavator front-face the target work surface.

Therefore, it is desirable to provide a technique that can reduce burden felt by an operator when making the upper turning body of the excavator front-face the target work surface.

Hereinafter, embodiments will be described with reference to the drawings.

[Overview of Excavator]

First, an outline of an excavator 100 according to the present embodiment will be described with reference to FIG. 1.

Figure 1:
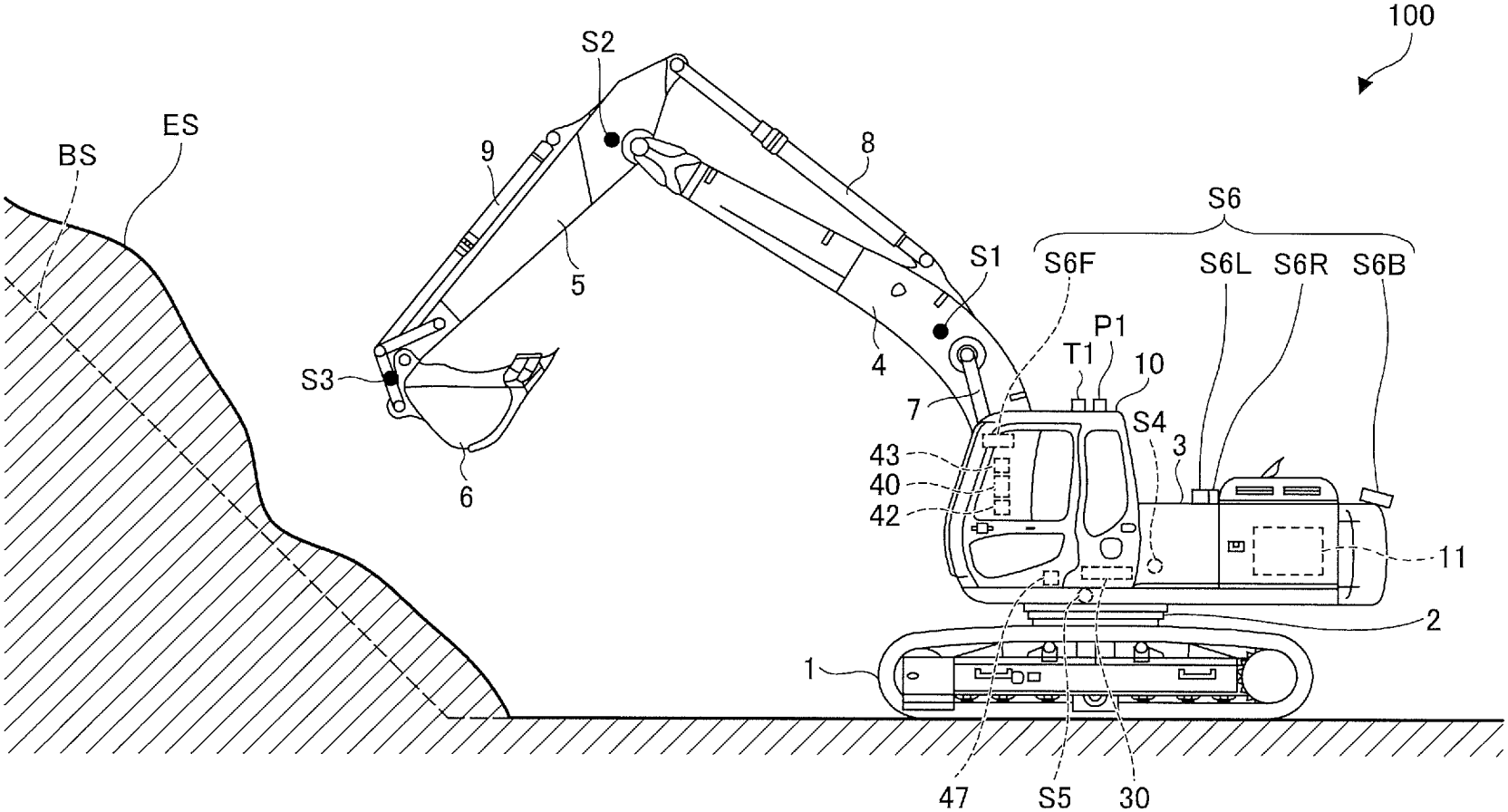
FIG. 1 is a side view of an excavator.

FIG. 1 is a side view of the excavator 100 as a drilling machine according to the present embodiment.

FIG. 1 illustrates the excavator 100 located on a horizontal plane facing an upward tilt surface ES to be worked on, and an upward slope surface BS (that is, the slope shape of the upward tilt surface ES after being worked on) that is an example of a target work surface to be described later.

The excavator 100 according to the present embodiment includes a lower traveling body 1; an upper turning body 3 that is mounted to the lower traveling body 1 in a turnable manner via a turning mechanism 2; a boom 4, an arm 5, and a bucket 6 that form an attachment (work machine); and a cabin 10.

In the lower traveling body 1, a crawler on the left and a crawler on the right, forming a pair, are hydraulically driven by traveling hydraulic motors 1L and 1R, respectively, to cause the excavator 100 to travel. That is, a pair of the traveling hydraulic motors 1L and 1R (an example of a traveling motor) drives the lower traveling body 1 (crawlers) as a driven portion.

The upper turning body 3 is driven by a turning hydraulic motor 2A to turn relative to the lower traveling body 1. That is, the turning hydraulic motor 2A is a turning driving unit which drives the upper turning body 3 that is a driven portion, and can change the orientation of the upper turning body 3.

The upper turning body 3 may be electrically driven by an electric motor (hereinafter, a "turning electric motor") instead of the turning hydraulic motor 2A. That is, similar to the turning hydraulic motor 2A, the turning electric motor is a turning driving unit which drives the upper turning body 3 that is a driven portion, and can change the orientation of the upper turning body 3.

The boom 4 is pivotally mounted to the front center of the upper turning body 3 so as to be elevated, the arm 5 is pivotally mounted to the leading end of the boom 4 so as to turn upward and downward, and the bucket 6 as an end attachment is pivotally mounted to the leading end of the arm 5 so as to turn upward and downward. The boom 4, the arm 5, and the bucket 6 are hydraulically driven by a boom cylinder 7, an arm cylinder 8, and a bucket cylinder 9, respectively, as hydraulic actuators.

The bucket 6 is an example of an end attachment, and another end attachment, such as a slope bucket, a dredging bucket, a breaker, or the like, may be attached to the leading end of the arm 5 instead of the bucket 6, depending on the work contents or the like.

The cabin 10 is an operator's cabin where an operator is seated, and is mounted on the front left side of the upper turning body 3.

The excavator 100 moves an actuator according to the operation of an operator seated in the cabin 10 to drive a motion element (driven element) such as the lower traveling body 1, the upper turning body 3, the boom 4, the arm 5, and the bucket 6.

Further, the excavator 100 may be configured to be remotely operated by an operator of a predetermined external apparatus (e.g., a support apparatus 200 or a management apparatus 300 described below), instead of or in addition to being configured to be operated by the operator in the cabin 10. In this case, for example, the excavator 100 transmits image information (captured image) output by an imaging device S6, which will be described later, to the external apparatus. The various information images (for example, various setting screens) displayed on a display device 40 of the excavator 100 described below may be similarly displayed on a display device provided in the external apparatus. This allows the operator to remotely control the excavator 100 while confirming, for example, the contents displayed on the display device provided on the external apparatus. The excavator 100 may then operate an actuator in response to a remote operation signal representing the contents of the remote operation, received from an external apparatus, to drive a motion element such as the lower traveling body 1, the upper turning body 3, the boom 4, the arm 5, and the bucket 6. If the excavator 100 is remotely operated, the interior of the cabin 10 may be unmanned. The following discussion assumes that the operator's operation includes at least one of the operator's operation on an operation apparatus 26 in the cabin 10 and the operator's remote operation on the external apparatus.

The excavator 100 may also automatically operate the hydraulic actuator regardless of the content of the operator's operation. Thus, the excavator 100 implements a function (hereinafter, an "automatic operation function" or a "machine control function") to automatically operate at least some of the motion elements such as the lower traveling body 1, the upper turning body 3, the boom 4, the arm 5, and the bucket 6.

The automatic operation function may include a function (so-called "semi-automatic operation function") to automatically operate a motion element (hydraulic actuator) other than the motion element (hydraulic actuator) to be operated, according to the operator's operation on the operation apparatus 26 or remote operation. Further, the automatic operation function may include a function to automatically operate at least some of a plurality of driven elements (hydraulic actuators) without the operator's operation on the operation apparatus 26 or remote operation (so-called "fully automatic operation function"). In the excavator 100, the interior of the cabin 10 may be unmanned if a fully automatic operation function is enabled. Further, the automatic operation function may include a function ("gesture operation function") in which the excavator 100 recognizes a gesture of a person such as a worker around the excavator 100 and automatically operates at least some of a plurality of driven elements (hydraulic actuators) depending on the content of the recognized gesture. Further, the semi-automatic operation function, the fully automatic operation function, and the gesture operation function may include a mode in which the motion content of the motion element (hydraulic actuator) subject to automatic operation is determined automatically in accordance with predefined rules. Further, the semi-automatic operation function, the fully automatic operation function, and the gesture operation function may include a mode in which the excavator 100 autonomously makes various determinations, and then determines, based on the determination result, the motion content a motion element (hydraulic actuator) subject to autonomous operation (so-called "autonomous operation function").

[Configuration of Excavator]

Next, a specific configuration of the excavator 100 according to the present embodiment will be described with reference to FIGS. 2 to 4 in addition to FIG. 1.

Figure 2:
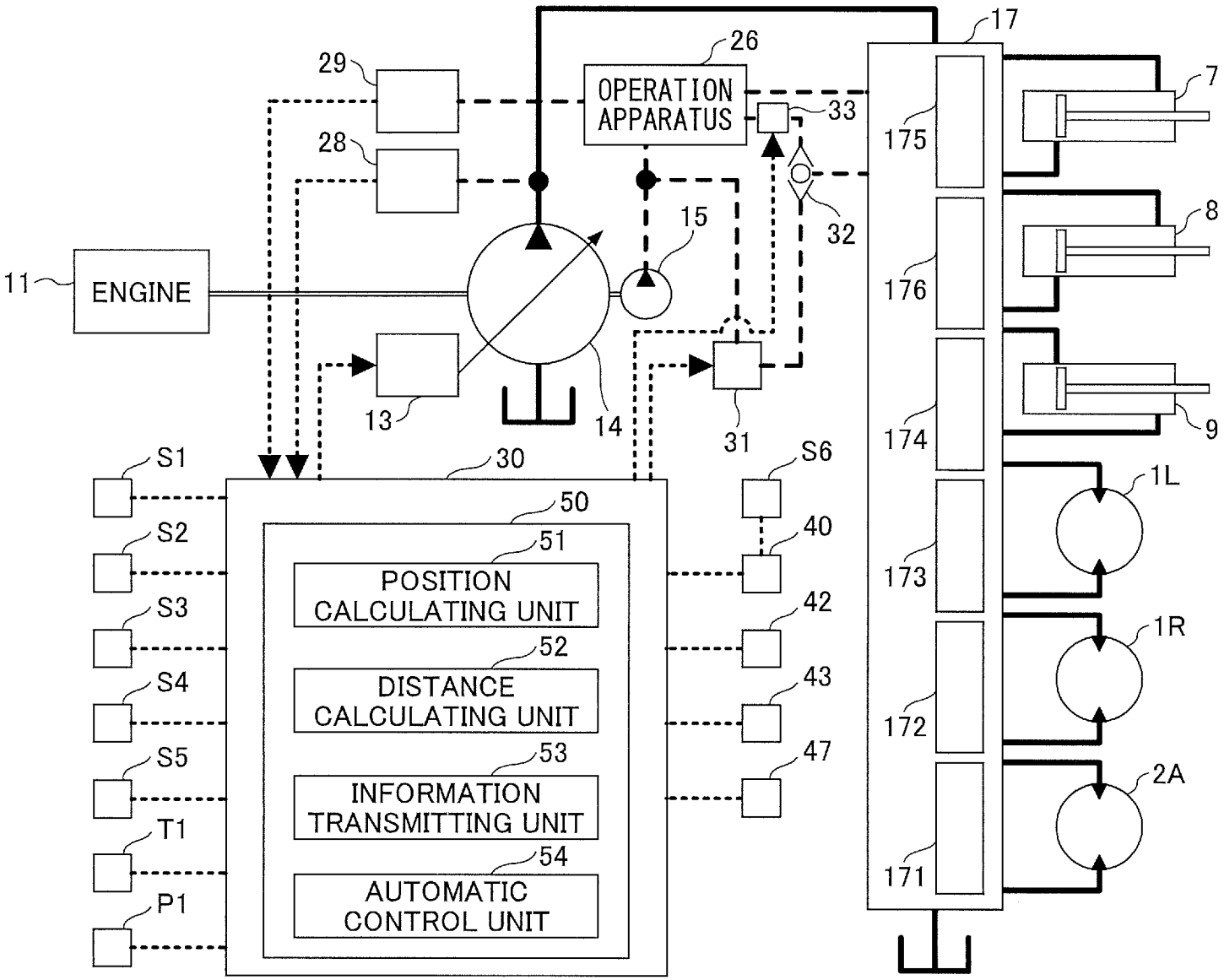
FIG. 2 is a diagram schematically illustrating an example of a configuration of the excavator.
Figure 3:
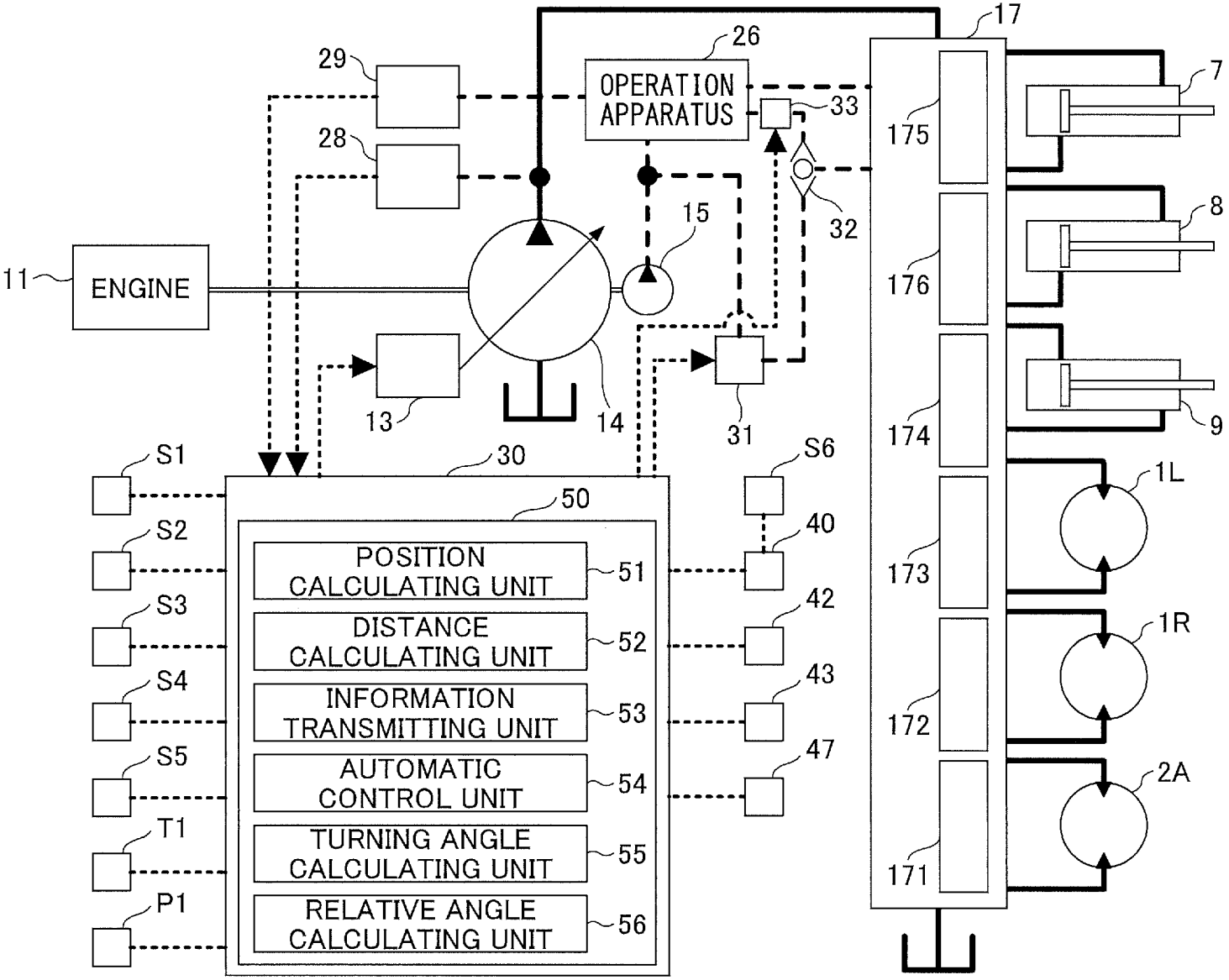
FIG. 3 is a diagram schematically illustrating another example of a configuration of the excavator.
Figure 4A:
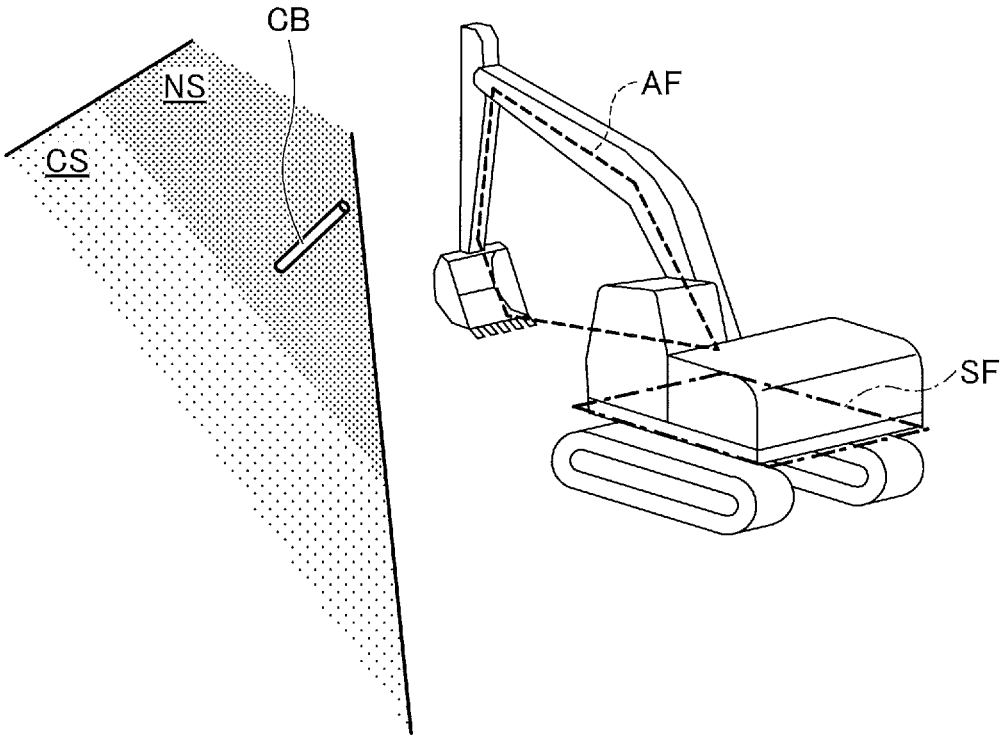
FIG. 4A is a diagram illustrating a specific example of a relative positional relationship between the excavator and a target work surface.
Figure 4B:
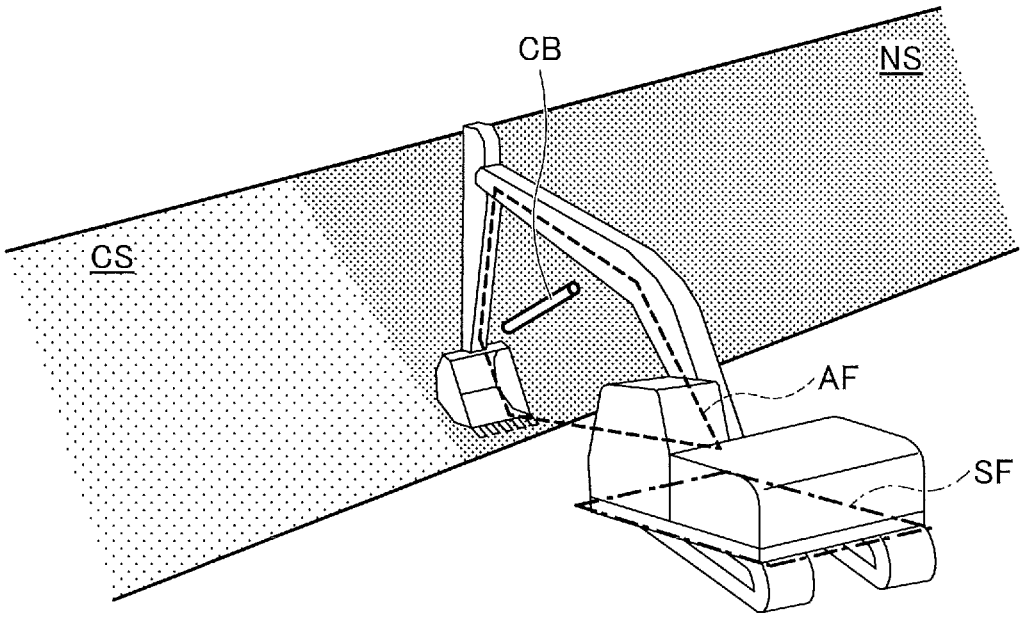
FIG. 4B is a diagram illustrating a specific example of a relative positional relationship between the excavator and a target work surface.

FIGS. 2 and 3 schematically illustrate one example and another example of the configuration of the excavator 100 according to the present embodiment, respectively. The excavators 100 of FIGS. 2 and 3 have a similar configuration except that the configuration of a machine guidance unit 50, which will be described later, included in a controller 30, is different. FIG. 4 (FIGS. 4A and 4B) illustrates a specific example of a relative positional relationship between the excavator 100 and a target work surface. Specifically, FIG. 4A is a diagram illustrating an example in which the upper turning body 3 of the excavator 100 is not front-facing the target work surface, and FIG. 4B is a diagram illustrating an example in which the upper turning body 3 of the excavator 100 is front-facing the target work surface.

In FIGS. 2 and 3, the mechanical power system, the hydraulic oil line, the pilot line, and the electrical control system are indicated as double, solid, dashed, and dotted lines, respectively. In FIGS. 4A and 4B, a work completion area CS represents the area where work on the target work surface (e.g., the upward slope surface BS) is completed, i.e., work on the target work surface has been completed, in the upward tilt surface ES that is the work target, and a work uncompleted area NS represents the area where work on the target work surface has not been completed. In FIGS. 4A and 4B, a cylindrical body CB is arranged such that the axis thereof is along the direction normal to the target work surface, and represents the direction normal to the target work surface.

The driving system of the excavator 100 according to the present embodiment includes an engine 11, a regulator 13, a main pump 14, and a control valve 17. The hydraulic driving system of the excavator 100 according to the present embodiment includes hydraulic actuators such as the traveling hydraulic motors 1L and 1R, the turning hydraulic motor 2A, the boom cylinder 7, the arm cylinder 8, and the bucket cylinder 9 for hydraulically driving the lower traveling body 1, the upper turning body 3, the boom 4, the arm 5, and the bucket 6, respectively, as described above.

The engine 11 is the main power source in the hydraulic driving system and is mounted, for example, at the back of the upper turning body 3. Specifically, the engine 11 constantly rotates at a predetermined target revolution speed under direct or indirect control by the controller 30 described below, to drive the main pump 14 and the pilot pump 15. The engine 11 is, for example, a diesel engine fueled with diesel oil.

The regulator 13 controls the discharge amount of the main pump 14. For example, the regulator 13 adjusts the angle (tilt angle) of the swash plate of the main pump 14 in response to control commands from the controller 30. The regulator 13 includes regulators 13L, 13R, for example, as described below.

The main pump 14, for example, is mounted at the back of the upper turning body 3, similar to the engine 11, to supply hydraulic oil to the control valve 17 through a high pressure hydraulic line. The main pump 14 is driven by the engine 11 as described above. The main pump 14 is, for example, a variable capacity hydraulic pump, and as described above, under the control of the controller 30, the tilt angle of the swash plate is adjusted by the regulator 13, thereby adjusting the stroke length of the piston and controlling the discharge flow rate (discharge pressure). The main pump 14 includes main pumps 14L, 14R, for example, as described below.

The control valve 17, for example, is mounted in a central portion of the upper turning body 3 and is a hydraulic control device that controls the hydraulic driving system in response to an operation by an operator to the operation apparatus 26 or a remote operation. As described above, the control valve 17 is connected to the main pump 14 via a high pressure hydraulic line, and selectively supplies hydraulic oil supplied from the main pump 14 to a hydraulic actuator (the traveling hydraulic motors 1L, 1R, the turning hydraulic motor 2A, the boom cylinder 7, the arm cylinder 8, and the bucket cylinder 9) depending on the state of the operation on the operation apparatus 26 or the remote operation. Specifically, the control valve 17 includes control valves 171 to 176 for controlling the flow rate and flow direction of hydraulic oil supplied from the main pump 14 to each of the hydraulic actuators. More specifically, the control valve 171 corresponds to the traveling hydraulic motor 1L, the control valve 172 corresponds to the traveling hydraulic motor 1R, and the control valve 173 corresponds to the turning hydraulic motor 2A. The control valve 174 corresponds to the bucket cylinder 9, the control valve 175 corresponds to the boom cylinder 7, and the control valve 176 corresponds to the arm cylinder 8. The control valve 175 also includes control valves 175L and 175R, for example, as described below, and the control valve 176 includes control valves 176L and 176R, for example, as described below. The control valves 171 to 176 are described in detail below (see FIG. 5).

The operation system of the excavator 100 according to the present embodiment includes a pilot pump 15 and the operation apparatus 26. Further, the operation system of the excavator 100 includes a shuttle valve 32 as a configuration related to the machine control function by the controller 30, which will be described later.

The pilot pump 15, for example, is mounted at the back of the upper turning body 3 and supplies pilot pressure to the operation apparatus 26 via a pilot line. The pilot pump 15 is, for example, a fixed capacitive hydraulic pump driven by the engine 11 as described above.

The operation apparatus 26 is provided near the operator's seat of the cabin 10 and is operation input means for the operator to perform the operations of various motion elements (the lower traveling body 1, the upper turning body 3, the boom 4, the arm 5, the bucket 6, and the like). That is, the operation apparatus 26 is operation input means for the operator to operate the hydraulic actuators (that is, the traveling hydraulic motors 1L and 1R, the turning hydraulic motors 2A, the boom cylinder 7, the arm cylinder 8, the bucket cylinder 9, and the like) driving the respective motion elements.

As illustrated in FIGS. 2 and 3, the operation apparatus 26 is a hydraulic pilot type. The operation apparatus 26 is connected to the control valves 17, either directly through a pilot line on the secondary side thereof or indirectly through the shuttle valve 32 described below provided on the pilot line on the secondary side. Thus, to the control valve 17, a pilot pressure corresponding to the operation states of the lower traveling body 1, the upper turning body 3, the boom 4, the arm 5, and the bucket 6 at the operation apparatus 26, may be input. Thus, the control valve 17 can drive the respective hydraulic actuators according to the operation state at the operation apparatus 26.

The operation apparatus 26 may be an electric type that outputs an electrical signal (hereinafter, an "operation signal") corresponding to the operation content, rather than a hydraulic type that outputs a pilot pressure. In this case, an electrical signal from the operation apparatus 26 is input to the controller 30, and the controller 30 may control the control valves 171 to 176 in the control valve 17 in response to the input electrical signal to implement the motion of the various hydraulic actuators depending on the operation content with respect to the operation apparatus 26. For example, the control valves 171 to 176 in the control valve 17 may be solenoid type spool valves driven by commands from the controller 30. Alternatively, for example, a hydraulic control valve (control valve for operation; "operation control valve") may be located between the pilot pump 15 and the pilot port of each control valve 171 to 176, which operates in response to electrical signals from the controller 30. The operation control valve may be, for example, a proportional valve 31, and the shuttle valve 32 may be omitted. In this case, the controller 30 controls the hydraulic operation control valve and increases or decreases the pilot pressure by electrical signals corresponding to the amount of operation (e.g., lever operation) when a manual operation is performed by using the operation apparatus 26 of the electric type. This allows the controller 30 to move the control valves 171 to 176 in accordance with the operating contents with respect to the operation apparatus 26. Hereinafter, the explanation will be advanced on the assumption that the operation control valve is the proportional valve 31.

The operation apparatus 26 includes, for example, a lever device for operating the arm 5 (the arm cylinder 8). The operation apparatus 26 includes lever devices 26A to 26C which operate, for example, the boom 4 (the boom cylinder 7), the bucket 6 (the bucket cylinder 9), and the upper turning body 3 (the turning hydraulic motor 2A) (see FIG. 6). The operation apparatus 26 includes, for example, a lever device or a pedal device for operating the pair of crawlers (the traveling hydraulic motors 1L and 1R) on the left and right of the lower traveling body 1.

The shuttle valve 32 has two inlet ports and one outlet port and causes the outlet port to output the hydraulic oil having the higher pilot pressure among the pilot pressures input to the two inlet ports. The shuttle valve 32 connects one of the two inlet ports to the operation apparatus 26 and the other one of the two inlet ports to the proportional valve 31. The outlet port of the shuttle valve 32 is connected, through a pilot line, to a pilot port of a corresponding control valve within the control valve 17 (for details, see FIG. 4). Thus, the shuttle valve 32 can cause the higher one of the pilot pressure generated by the operation apparatus 26 and the pilot pressure generated by the proportional valve 31, to act on the pilot port of the corresponding control valve. That is, the controller 30 described later outputs from the proportional valve 31 a pilot pressure higher than the pilot pressure on the secondary side output from the operation apparatus 26, so that the corresponding control valve can be controlled regardless of the operation with respect to the operation apparatus 26 by the operator, and the motion of various motion elements can be controlled. The shuttle valve 32 includes, for example, shuttle valves 32AL, 32AR, 32BL, 32BR, 32CL, 32CR, as described below.

The control system of the excavator 100 according to the present embodiment includes the controller 30, a discharge pressure sensor 28, an operation pressure sensor 29, proportional valves 31 and 33, the display device 40, an input device 42, a sound output device 43, a storage device 47, a boom angle sensor S1, an arm angle sensor S2, a bucket angle sensor S3, a machine tilt sensor S4, a turning state sensor S5, an imaging device S6, a positioning device P1, and a communication device T1.

The controller 30 (an example of a control apparatus) is provided, for example, in the cabin 10, to perform drive control for the excavator 100. The controller 30 may implement functions thereof by any hardware, software, or combinations thereof. For example, the controller 30 is configured centering around a microcomputer including a CPU (Central Processing Unit), a memory device such as a RAM (Random Access Memory), a non-volatile auxiliary storage device such as a ROM (Read Only Memory), and an interface device for various inputs and outputs. The controller 30 implements various functions by executing, for example, various programs installed in the non-volatile auxiliary storage device on the CPU.

For example, the controller 30 sets a target revolution speed and performs drive control for constant rotation of the engine 11 based on a work mode and the like preset by a predetermined operation on the input device 42 by an operator and the like.

For example, the controller 30 outputs a control command to the regulator 13 as needed to change the discharge amount of the main pump 14.

For example, when the operation apparatus 26 is an electric type, the controller 30 may control the proportional valve 31 to implement the operation of the hydraulic actuator according to the operation content at the operation apparatus 26 as described above.

For example, the controller 30 may implement remote operation of the excavator 100 by using the proportional valve 31. Specifically, the controller 30 may output, to the proportional valve 31, a control command corresponding to the content of the remote operation specified by the remote operation signal received from the external apparatus. The proportional valve 31 may then use the hydraulic oil supplied from the pilot pump 15 to output a pilot pressure corresponding to the control command from the controller 30 to apply the pilot pressure to the pilot port of the corresponding control valve in the control valve 17. Thus, the contents of the remote operation are reflected to the motion of the control valve 17, and the hydraulic actuator implements the motion of various motion elements (driven elements) according to the contents of the remote operation.

For example, the controller 30 controls a surrounding monitoring function. In the surrounding monitoring function, based on the information acquired by the imaging device S6, entry of an object targeted for monitoring into a predetermined range (hereinafter, the "monitored range") around the excavator 100 is monitored. The process of determining the entry of an object targeted for monitoring into the monitored range may be performed by the imaging device S6 or by an external device (e.g., the controller 30) outside the imaging device S6. The objects that are monitored may include, for example, persons, trucks, other construction machines, utility poles, suspended loads, pylons, buildings, and the like.

For example, the controller 30 controls an object detection notification function. In the object detection notification function, when it is determined that an object targeted for monitoring is present in the monitored range by the surrounding monitoring function, the object detection notification function notifies the presence of the object targeted for monitoring to the operator in the cabin 10 or to the surroundings of the excavator 100. The controller 30 may implement the object detection notification function using, for example, the display device 40 or the sound output device 43.

For example, the controller 30 controls a motion limitation function. In the motion limitation function, for example, the motion of the excavator 100 is limited when it is determined that an object targeted for monitoring exists within the monitored range by the surrounding monitoring function. Hereinafter, the explanation will focus on the case where the object targeted for monitoring is a person.

For example, before the actuator operates, when it is determined that an object targeted for monitoring, such as a person, exists within a predetermined range (within a monitored range) from the excavator 100 based on the information obtained by the imaging device S6, even if the operator operates the operation apparatus 26, the controller 30 may limit the actuator's motion to be inoperable or to be a slow operation. Specifically, the controller 30 may disable the motion of the actuator by locking the gate lock valve when it is determined that a person is present within the monitored range. In the case of the operation apparatus 26 that is an electric type, the motion of the actuator can be disabled by disabling the signal from the controller 30 to the operation control valve (the proportional valve 31). The same applies to other types of the operation apparatus 26 when a pilot pressure corresponding to a control command is output from the controller 30 and an operation control valve (the proportional valve 31) is used to apply the pilot pressure to a pilot port of a corresponding control valve in the control valve 17. When operating the actuator at a slow speed is desired, the control signal from the controller 30 to the operation control valve (the proportional valve 31) can be limited to contents corresponding to a relatively low pilot pressure, thereby allowing the actuator to operate at a slow speed. Thus, when it is determined that the detected object targeted for monitoring is within the monitored range, the actuator is not driven even if the operation apparatus 26 is operated, or is driven at an operation speed (slow speed) that is less than the operation speed corresponding to the operation input to the operation apparatus 26. Further, the actuator operation may be stopped or decelerated regardless of the operator's operation if it is determined that an object targeted for monitoring, such as a person, exists within the monitored range while the operator is operating the operation apparatus 26. Specifically, when it is determined that a person is within the monitored range, the actuator may be stopped by locking the gate lock valve. When pilot pressure corresponding to a control command from the controller 30 is output, and an operation control valve (the proportional valve 31) is used to apply the pilot pressure to a pilot port of a corresponding control valve in the control valve, the motion of the actuator may be disabled or limited to a decelerated motion by disabling the signal from the controller 30 to the operation control valve (the proportional valve 31) or by outputting a deceleration command to the operation control valve. Also, if the detected object targeted for monitoring is a truck, control of the stopping or decelerating the actuator may or may not be performed. For example, the actuator may be controlled to avoid the detected truck. In this manner, the type of object detected may be recognized and the actuator may be controlled based on that recognition.

The controller 30 may, as a matter of course, apply the same motion limitation function as that of the case of operating the operation apparatus 26, to the case where the remote operation of the excavator 100 is performed.

For example, the controller 30 controls the machine guidance function that guides the manual operation of the excavator 100 by, for example, an operator. The controller 30 also controls the machine control function that automatically assists the operator in manually operating the excavator 100, for example. That is, the controller 30 includes the machine guidance unit 50 as a function unit of the machine guidance function and the machine control function.

Some of the functions of the controller 30 may be implemented by other controllers (control apparatuses). That is, the functions of the controller 30 may be implemented in a manner that is distributed over a plurality of controllers. For example, the machine guidance and machine control functions may be implemented by an exclusive-use controller (control apparatus).

The discharge pressure sensor 28 detects the discharge pressure of the main pump 14. A detection signal corresponding to the discharge pressure detected by the discharge pressure sensor 28 is incorporated into the controller 30. The discharge pressure sensor 28 includes discharge pressure sensors 28L and 28R, for example, as described below.

As described above, the operation pressure sensor 29 detects the pilot pressure on the secondary side of the operation apparatus 26, i.e., the pilot pressure corresponding to the operation state (e.g., the operation content such as the operation direction, the operation amount, or the like) with respect to the respective motion elements (i.e., the hydraulic actuators) at the operation apparatus 26. A pilot pressure detection signal corresponding to an operation state of elements such as the lower traveling body 1, the upper turning body 3, the boom 4, the arm 5, and the bucket 6 at the operation apparatus 26 by the operation pressure sensor 29 is incorporated into the controller 30. The operation pressure sensor 29 includes operation pressure sensors 29A to 29C, for example, as described below.

Note that, instead of the operation pressure sensor 29, other sensors capable of detecting the operation state of the respective motion elements at the operation apparatus 26 may be provided, such as an encoder or potentiometer capable of detecting an operation amount (tilt amount) or the tilt direction of the lever devices 26A to 26C. If the operation apparatus 26 is electrically powered, the operation pressure sensor 29 is omitted.

The proportional valve 31 is provided on the pilot line connecting the pilot pump 15 to the shuttle valve 32. The proportional valve 31 is configured, for example, to change the flow area thereof (the cross-sectional area in which hydraulic oil is allowed to flow). The proportional valve 31 operates in response to a control command input from the controller 30. Thus, the controller 30 may supply hydraulic oil discharged from the pilot pump 15 to the pilot port of the corresponding control valve in the control valve 17 via the proportional valve 31 and the shuttle valve 32, even if the operation apparatus 26 (specifically, the lever devices 26A to 26C) is not operated by an operator. The proportional valve 31 includes proportional valves 31AL, 31AR, 31BL, 31BR, 31CL, 31CR, as described below, for example.

The proportional valve 33 is provided on the pilot line connecting the operation apparatus 26 and the shuttle valve 32. The proportional valve 33 is configured to, for example, change the flow area thereof. The proportional valve 33 operates in response to control commands input from the controller 30. This allows the controller 30 to forcibly depressurize the pilot pressure output from the operation apparatus 26 when the operation apparatus 26 (specifically, the lever devices 26A to 26C) is operated by an operator. Accordingly, the controller 30 may forcibly suppress or stop the motion of the hydraulic actuator corresponding to the operation at the operation apparatus 26 even when the operation apparatus 26 is operated. The controller 30, for example, can depressurize the pilot pressure output from the operation apparatus 26 to a level lower than the pilot pressure output from the proportional valve 31 even when the operation apparatus 26 is operated. Thus, the controller 30 can control the proportional valve 31 and the proportional valve 33, for example, to ensure that the desired pilot pressure is applied to the pilot port of the control valve in the control valve 17 regardless of the operation content of the operation apparatus 26. Accordingly, the controller 30 can more appropriately implement the automatic operation function and the remote operation function of the excavator 100 by controlling the proportional valve 33 in addition to the proportional valve 31. The proportional valve 33 includes proportional valves 33AL, 33AR, 33BL, 33BR, 33CL, and 33CR as described below.

The display device 40 is provided at a location within the cabin 10 where the display device 40 is readily visible from a seated operator and displays various information images under the control of the controller 30. The display device 40 may be connected to the controller 30 via in-vehicle communication networks such as CAN (Controller Area Network) or may be connected to the controller 30 via a one-to-one exclusive-use line.

The input device 42 is positioned within reach of a seated operator in the cabin 10 and receives various operation inputs from the operator and outputs a signal corresponding to the operation inputs to the controller 30. The input device 42 includes a touch panel mounted on a display of the display device 40 for displaying various information images, a knob switch mounted on the leading end of a lever portion of the lever devices 26A to 26C, a button switch, a lever, a toggle, a rotating dial, and the like mounted around the display device 40. A signal corresponding to the operation content with respect to the input device 42 is incorporated into the controller 30.

The sound output device 43 is provided, for example, in the cabin 10, and is connected to the controller 30, and outputs predetermined sounds under the control of the controller 30. The sound output device 43 may be, for example, a speaker, a buzzer, or the like. The sound output device 43 outputs various types of information by sound in accordance with a sound output command from the controller 30.

The storage device 47 is provided in the cabin 10, for example, for storing various kinds of information under the control of the controller 30. The storage device 47 is a non-volatile storage medium such as, for example, a semiconductor memory. The storage device 47 may store information output by the various devices during operation of the excavator 100 and may store information acquired through the various devices before operation of the excavator 100 is started. The storage device 47 may store, for example, data relating to a target work surface acquired through the communication device T1 or the like or set through the input device 42 or the like. The target work surface may be set (stored) by an operator of the excavator 100 or may be set by a construction manager or the like.

The boom angle sensor S1 is mounted to the boom 4 and detects the depression/elevation angle of the boom 4 relative to the upper turning body 3 (hereinafter, the "boom angle"), for example, the angle of a straight line connecting the fulcrums points at both ends of the boom 4 relative to the turning plane of the upper turning body 3 in a side view. The boom angle sensor S1 may include, for example, a rotary encoder, an acceleration sensor, an angular velocity sensor, a 6-axis sensor, an IMU (Inertial Measurement Unit), or the like. Further, the boom angle sensor S1 may include a potentiometer using a variable resistor and a cylinder sensor for detecting the stroke amount of a hydraulic cylinder (the boom cylinder 7) corresponding to the boom angle. The same applies to the arm angle sensor S2 and the bucket angle sensor S3. A detection signal corresponding to the boom angle output by the boom angle sensor S1 is incorporated into the controller 30.

The arm angle sensor S2 is mounted to the arm 5 and detects the rotation angle of the arm 5 with respect to the boom 4 (hereinafter, an "arm angle"), for example, the angle formed between a straight line connecting the fulcrum points at both ends of the boom 4 and a straight line connecting the fulcrum points at both ends of the arm 5 in a side view. A detection signal corresponding to the arm angle output by the arm angle sensor S2 is incorporated into the controller 30.

The bucket angle sensor S3 is mounted to the bucket 6 and detects the rotation angle (hereinafter, a "bucket angle") of the bucket 6 with respect to the arm 5, for example, the angle formed between a straight line connecting the fulcrum points at both ends of the arm 5 and a straight line connecting the fulcrum point and the leading end (edge of the blade) of the bucket 6 in a side view. A detection signal corresponding to the bucket angle output by the bucket angle sensor S3 is incorporated into the controller 30.

The machine tilt sensor S4 detects the tilt state of the machine (the upper turning body 3 or the lower traveling body 1) relative to the horizontal plane. For example, the machine tilt sensor S4 is mounted on the upper turning body 3 and detects the tilt angle of the excavator 100 (i.e., the upper turning body 3) about the two axes in the front-back direction and the left-right direction (hereinafter, a "front-back tilt angle" and a "left-right tilt angle"). The machine tilt sensor S4 may include, for example, a rotary encoder, an acceleration sensor, an angular velocity sensor, a 6-axis sensor, an IMU, or the like. A detection signal corresponding to the tilt angle (front-back tilt angle and left-right tilt angle) output by the machine tilt sensor S4 is incorporated into the controller 30.

The turning state sensor S5 outputs detection information relating to the turning state of the upper turning body 3. The turning state sensor S5 detects, for example, the turning angular velocity and the turning angle of the upper turning body 3. The turning state sensor S5 may include, for example, a gyro sensor, a resolver, a rotary encoder, or the like. The detection signal, corresponding to the turning angle and the turning angular velocity of the upper turning body 3, output by the turning state sensor S5, is incorporated into the controller 30.

The imaging device S6 captures the surroundings of the excavator 100. The imaging device S6 includes a camera S6F for capturing images in front of the excavator 100, a camera S6L for capturing images on the left of the excavator 100, a camera S6R for capturing images on the right of the excavator 100, and a camera S6B for capturing images behind the excavator 100.

The camera S6F is mounted, for example, on the ceiling of the cabin 10, i.e., inside the cabin 10. The camera S6F may be mounted on the outside of the cabin 10, such as the roof of the cabin 10, the side surfaces of the boom 4, or the like. The camera S6L is mounted, for example, on the left end of the upper surface of the upper turning body 3, the camera S6R is mounted, for example, on the right end of the upper surface of the upper turning body 3, and the camera S6B is mounted, for example, on the back end of the upper surface of the upper turning body 3.

The imaging device S6 is an example of a spatial recognition device that acquires information for recognizing the surrounding condition of the excavator 100. The imaging device S6 (the cameras S6F, S6B, S6L, and S6R) is, for example, a monocular wide angle camera having a very wide angle of view. The imaging device S6 may be a stereo camera or a distance image camera. An image captured by the imaging device S6 is incorporated into the controller 30 via the display device 40.

The imaging device S6 may also function as an object detection device for detecting an object around the excavator 100 based on the acquired image information. In this case, the imaging device S6 may detect an object present around the excavator 100. Objects to be detected may include, for example, humans, animals, vehicles, construction machinery, buildings, holes, and the like. The imaging device S6 may calculate a distance from the imaging device S6 or the excavator 100 to the recognized object. The imaging device S6 as an object detection device may include, for example, a stereo camera, a distance image sensor, or the like. Instead of or in addition to the imaging device S6, there may be provided other spatial recognition devices and object detection devices, such as, for example, ultrasonic sensors, millimeter wave radars, LIDAR (Light Detecting and Ranging), infrared sensors, and the like.

The imaging device S6 may be directly communicably connected to the controller 30.

The positioning device P1 measures the position and orientation of the upper turning body 3. The positioning device P1 is, for example, a GNSS (Global Navigation Satellite System) compass that detects the position and orientation of the upper turning body 3, and a detection signal corresponding to the position and orientation of the upper turning body 3 is incorporated into the controller 30. Among the functions of the positioning device P1, the function of detecting the orientation of the upper turning body 3 may be replaced by an orientation sensor mounted on the upper turning body 3.

The communication device T1 communicates with an external apparatus through a predetermined network including a mobile communication network in which a base station is the terminal, a satellite communication network, the Internet network, or the like. The communication device T1 is, for example, a mobile communication module corresponding to a mobile communication standard such as LTE (Long Term Evolution), 4G (4th Generation), and 5G (5th Generation), or a satellite communication module for connecting to a satellite communication network.

The machine guidance unit 50 performs control of the excavator 100 with respect to, for example, the machine guidance function. The machine guidance unit 50 communicates to an operator, for example, through the display device 40 or the sound output device 43, work information such as a distance between a target work surface and a leading end of an attachment, specifically, the working portion of an end attachment. The data relating to the target work surface is pre-stored in the storage device 47 as described above, for example. The data relating to the target work surface is represented, for example, by a reference coordinate system. The reference coordinate system is, for example, a world geodetic system. The world geodetic system is a three-dimensional orthogonal XYZ coordinate system in which the origin is at the center of earth's gravity, the X-axis is in the direction of the intersection of the Greenwich meridian and the equator, the Y-axis is in the direction of 90 degrees east longitude, and the Z-axis is in the direction of the Arctic. The operator may define any point of the construction site as a reference point and set the target work surface by the relative positional relationship with the reference point through the input device 42. The working portion of the bucket 6 is, for example, the claw tip of the bucket 6, the back of the bucket 6, and the like. If, for example, a breaker is employed instead of the bucket 6 as an end attachment, the leading end of the breaker corresponds to the working portion. The machine guidance unit 50 notifies an operator of work information through the display device 40, the sound output device 43, or the like, and guides the operator to operate the excavator 100 through the operation apparatus 26.

Further, the machine guidance unit 50 controls the excavator 100 with respect to, for example, the machine control function. For example, when the operator is performing a manual drilling operation, the machine guidance unit 50 may automatically operate at least one of the boom 4, the arm 5, and the bucket 6, for example, so that the target work surface and the leading end position of the bucket 6 coincide with each other.

The machine guidance unit 50 acquires information from the boom angle sensor S1, the arm angle sensor S2, the bucket angle sensor S3, the machine tilt sensor S4, the turning state sensor S5, the imaging device S6, the positioning device P1, the communication device T1, and the input device 42. The machine guidance unit 50, for example, calculates the distance between the bucket 6 and the target work surface based on the acquired information, notifies the operator of the extent of the distance between the bucket 6 and the target work surface based on the sound from the sound output device 43 and the image displayed on the display device 40, and automatically controls the operation of the attachment so that the leading end of the attachment (specifically, the working portion such as the claw tip or the back surface of the bucket 6) coincides with the target work surface. The machine guidance unit 50 includes a position calculating unit 51, a distance calculating unit 52, an information transmitting unit 53, and an automatic control unit 54 as detailed functional configurations related to the machine guidance function and the machine control function.

The position calculating unit 51 calculates a position of a predetermined positioning target. For example, the position calculating unit 51 calculates a coordinate point in the reference coordinate system of the leading end of the attachment, specifically, the working portion such as the claw tip or the back surface of the bucket 6. Specifically, the position calculating unit 51 calculates the coordinate point of the working portion of the bucket 6 from the respective elevation angles (the boom angle, the arm angle, and the bucket angle) of the boom 4, the arm 5, and the bucket 6.

The distance calculating unit 52 calculates the distance between the two positioning targets. For example, the distance calculating unit 52 calculates the distance between the leading end of the attachment, specifically, the working portion such as the claw tip or the back surface of the bucket 6, and the target work surface. The distance calculating unit 52 may calculate an angle (relative angle) between the back surface as a working portion of the bucket 6 and the target work surface.

The information transmitting unit 53 transmits (notifies) various kinds of information to an operator of the excavator 100 through predetermined notification means such as the display device 40 or the sound output device 43. The information transmitting unit 53 notifies the operator of the excavator 100 of the magnitude (extent) of various distances calculated by the distance calculating unit 52. For example, the distance (magnitude) between the leading end of the bucket 6 and the target work surface is communicated to the operator by using at least one of the visual information displayed by the display device 40 and the auditory information output by the sound output device 43. The information transmitting unit 53 may communicate to an operator the relative angle (magnitude) between the back surface of the bucket 6 as the work portion and the target work surface using at least one of the visual information provided by the display device 40 and the auditory information provided by the sound output device 43.

Specifically, the information transmitting unit 53 transmits the magnitude of the distance (for example, the vertical distance) between the working portion of the bucket 6 and the target work surface to the operator using an intermittent sound generated by the sound output device 43. In this case, the information transmitting unit 53 may shorten the intervals between the intermittent sounds as the vertical distance decreases and may increase the intervals between the intermittent sounds as the vertical distance increases. Further, the information transmitting unit 53 may use continuous sounds and may represent the difference in the magnitude of the vertical distance by changing the pitch, intensity, or the like of the sound. The information transmitting unit 53 may issue an alarm through the sound output device 43 when the leading end of the bucket 6 is at a position lower than the target work surface, that is, exceeds the target work surface. The alarm is, for example, a continuous sound that is significantly louder than an intermittent sound.

The information transmitting unit 53 may display, on the display device 40 as work information, the magnitude of the distance between the leading end of the attachment, specifically, the working portion of the bucket 6, and the target work surface, the magnitude of the relative angle between the back surface of the bucket 6 and the target work surface, or the like. The display device 40 displays the work information received from the information transmitting unit 53 together with image data received from the imaging device S6, for example, under the control of the controller 30. The information transmitting unit 53 may communicate the magnitude of the vertical distance to the operator using, for example, an image of an analog meter or an image of a bar graph indicator.

The automatic control unit 54 automatically assists the operator in manually operating the excavator 100, by automatically moving the actuator. Specifically, as described below, the automatic control unit 54 can individually and automatically adjust the pilot pressure acting on the control valves (specifically, control valves 173, 175L, 175R, and 174) corresponding to a plurality of hydraulic actuators (specifically, the turning hydraulic motor 2A, the boom cylinder 7, and the bucket cylinder 9). Thus, the automatic control unit 54 can automatically move the respective hydraulic actuators. The control relating to the machine control function by the automatic control unit 54 may be performed, for example, when a predetermined switch included in the input device 42 is pressed down. The predetermined switch may be, for example, a machine control switch ("MC (Machine Control) switch") and may be positioned as a knob switch at the tip of the operator's grip portion of the operation apparatus 26 (e.g., a lever device corresponding to the operation of the arm 5). Hereinafter, the explanation is based on the assumption that when the MC switch is pressed down, the machine control function is enabled.

For example, when the MC switch, or the like, is pressed down, the automatic control unit 54 automatically expands and contracts at least one of the boom cylinder 7 and the bucket cylinder 9, in accordance with the motion of the arm cylinder 8, to assist in the drilling work or the shaping work. Specifically, the automatic control unit 54 automatically expands or contracts at least one of the boom cylinder 7 and the bucket cylinder 9 so that the target work surface coincides with a position of a working portion, such as the claw tip or the back surface of the bucket 6, when the operator performs a manual operation to close the arm 5 (hereinafter, an "arm closing operation"). In this case, the operator can close the arm 5 while matching the claw tip of the bucket 6 or the like to the target work surface, for example, by simply performing an arm closing operation with respect to the lever device corresponding to the operation of the arm 5.

When the MC switch is pressed down, the automatic control unit 54 may automatically rotate the turning hydraulic motor 2A (an example of an actuator) in order to cause the upper turning body 3 to front-face the target work surface. Hereinafter, the control in which the upper turning body 3 is caused to front-face the target work surface by the controller 30 (the automatic control unit 54) is referred to as "front-face control". Accordingly, the operator, or the like, can simply press a predetermined switch or operate the lever device 26C described below which corresponds to the turning operation while the switch is pressed down, so that the upper turning body 3 is caused to front-face the target work surface. Further, the operator may simply press the MC switch to cause the upper turning body 3 to front-face the target work surface and start a machine control function related to the drilling work and the like on the target work surface described above.

For example, the state in which the upper turning body 3 of the excavator 100 front-faces the target work surface is such that the leading end of the attachment (e.g., the claw tip or the back surface as the working portion of the bucket 6) can be moved along the inclined direction of the target work surface (the upward slope surface BS) in accordance with the motion of the attachment. Specifically, the state in which the upper turning body 3 of the excavator 100 front-faces the target work surface is a state in which the operation plane (the operation plane of the attachment) AF of the attachment vertical to a turning plane SF of the excavator 100 includes a normal line of the target work surface corresponding to the cylindrical body CB (that is, a state in accordance with the normal line), as illustrated in FIG. 4B.

As illustrated in FIG. 4A, if the attachment operation plane AF of the excavator 100 is not in a state that includes the normal line of the target work surface corresponding to the cylindrical body CB, the leading end of the attachment cannot move in the tilt direction of the target work surface. As a result, the excavator 100 cannot properly perform construction work on the target work surface. On the other hand, the automatic control unit 54 automatically rotates the turning hydraulic motor 2A, so that the upper turning body 3 front-faces the target work surface as illustrated in FIG. 4B. This allows the excavator 100 to properly perform construction work on the target work surface.

In the front-face control, for example, when the vertical distance between the coordinate point at the left end of the claw tip of the bucket 6 and the target work surface (hereinafter, "the left end vertical distance") is equal to the vertical distance between the coordinate point at the right end of the claw tip of the bucket 6 and the target work surface (hereinafter, "the right end vertical distance"), the automatic control unit 54 determines that the excavator front-faces the target work surface. Further, the automatic control unit 54 may determine that the excavator 100 front-faces the target work surface, not when the left end vertical distance is equal to the right end vertical distance (that is, when the difference between the left end vertical distance and the right end vertical distance is zero), but when this difference is less than or equal to a predetermined value.

Further, in the front-face control, the automatic control unit 54 may operate the turning hydraulic motor 2A based on, for example, the difference between the left end vertical distance and the right end vertical distance. Specifically, if the lever device 26C corresponding to the turning operation is operated while the predetermined switch such as the MC switch or the like is pressed down, it is determined whether the lever device 26C is operated in a direction in which the upper turning body 3 is caused to front-face the target work surface. For example, when the lever device 26C is operated in a direction in which the vertical distance between the claw tip of the bucket 6 and the target work surface (the upward slope surface) is increased, the automatic control unit 54 does not perform the front-face control. On the other hand, when the turning operation lever is operated in a direction in which the vertical distance between the claw tip of the bucket 6 and the target work surface (the upward slope surface) is reduced, the automatic control unit 54 performs front-face control. As a result, the automatic control unit 54 can operate the turning hydraulic motor 2A so that the difference between the left end vertical distance and the right end vertical distance is reduced. Thereafter, the automatic control unit 54 stops the turning hydraulic motor 2A when the difference becomes less than or equal to a predetermined value or zero. The automatic control unit 54 may set the turning angle, at which the difference is less than or equal to a predetermined value or equal to zero, as a target angle, and perform operation control of the turning hydraulic motor 2A so that the angle difference between the target angle and the present turning angle (specifically, a detected value based on a detection signal of the turning state sensor S5) becomes zero. In this case, the turning angle is, for example, the angle of the front-back axis of the upper turning body 3 relative to the reference direction.

As described above, when a turning electric motor is mounted to the excavator 100 instead of the turning hydraulic motor 2A, the automatic control unit 54 performs front-face control of the turning electric motor (an example of an actuator) as a control target.

Further, as illustrated in FIG. 3, the machine guidance unit 50 may further include a turning angle calculating unit 55 and a relative angle calculating unit 56.

The turning angle calculating unit 55 calculates the turning angle of the upper turning body 3. This allows the controller 30 to identify the current orientation of the upper turning body 3. The turning angle calculating unit 55 calculates, as the turning angle, the angle of the front-back axis of the upper turning body 3 with respect to the reference direction, based on the output signal of a GNSS compass included in the positioning device P1, for example. The turning angle calculating unit 55 may calculate the turning angle based on the detection signal of the turning state sensor S5. When a reference point is set in the construction site, the turning angle calculating unit 55 may set the direction in which the reference point is viewed from the turning axis as the reference direction.

The turning angle indicates the direction in which the attachment operation plane extends relative to the reference direction. The attachment operation plane is, for example, a virtual plane that traverses the attachment and is positioned perpendicular to the turning plane. A turning plane is, for example, a virtual plane including the bottom of a turning frame perpendicular to the turning axis. For example, the controller 30 (the machine guidance unit 50) determines that the upper turning body 3 front-faces the target work surface when it is determined that the attachment operation plane includes the normal line of the target work surface.

The relative angle calculating unit 56 calculates the turning angle (relative angle) necessary for making the upper turning body 3 front-face the target work surface. The relative angle is a relative angle formed between the direction of the front-back axis of the upper turning body 3 when the upper turning body 3 front-faces the target work surface and the current direction of the front-back axis of the upper turning body 3, for example. For example, the relative angle calculating unit 56 calculates the relative angle based on the data relating to the target work surface stored in the storage device 47 and the turning angle calculated by the turning angle calculating unit 55.

When the lever device 26C corresponding to the turning operation is operated while the predetermined switch such as the MC switch or the like is pressed down, the automatic control unit 54 determines whether the turning operation is performed in a direction in which the upper turning body 3 is caused to front-face the target work surface. When the automatic control unit 54 determines that the turning operation has been performed in the direction in which the upper turning body 3 is caused to front-face the target work surface, the automatic control unit 54 sets the relative angle calculated by the relative angle calculating unit 56 as the target angle. When the turning angle changes after the lever device 26C is operated to reach the target angle, the automatic control unit 54 determines that the upper turning body 3 front-faces the target work surface and may stop the movement of the turning hydraulic motor 2A. Accordingly, the automatic control unit 54 can cause the upper turning body 3 to front-face the target work surface on the basis of the configuration illustrated in FIG. 3.

[Hydraulic System of the Excavator]

Next, a hydraulic system of the excavator 100 according to the present embodiment will be described with reference to FIG. 5.

Figure 5:
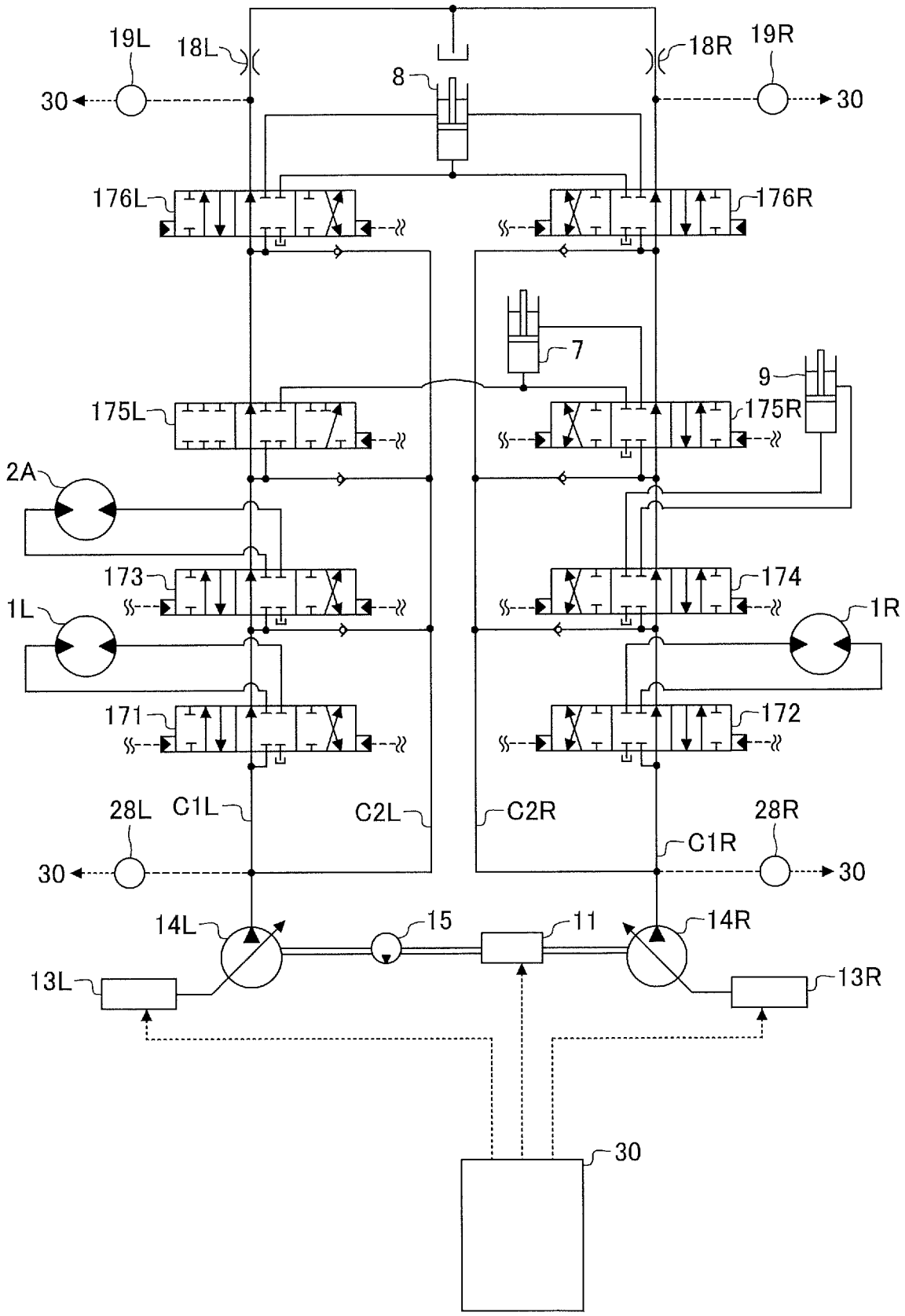
FIG. 5 is a diagram schematically illustrating an example of a configuration of a hydraulic system of the excavator.

FIG. 5 is a diagram schematically illustrating an example of the configuration of the hydraulic system of the excavator 100 according to the present embodiment.

In FIG. 5, the mechanical power system, the hydraulic oil line, the pilot line, and the electrical control system are illustrated as double, solid, dashed, and dotted lines, respectively, as in FIG. 2 and the like.

The hydraulic system realized by the hydraulic circuit circulates the hydraulic oil from each of the main pumps 14L and 14R driven by the engine 11 to the hydraulic oil tank through center bypass oil lines C1L and C1R, and parallel oil lines C2L and C2R.

The center bypass oil line C1L starts at the main pump 14L and passes through the control valves 171, 173, 175L, and 176L disposed in the control valve 17 in this order, to reach the hydraulic oil tank.

The center bypass oil line C1R starts at the main pump 14R and passes through control valves 172, 174, 175R, and 176R, which are disposed in the control valve 17 in this order, to reach the hydraulic oil tank.

The control valve 171 is a spool valve which supplies hydraulic oil discharged from the main pump 14L to the traveling hydraulic motor 1L and discharges the hydraulic oil discharged from the traveling hydraulic motor 1L to the hydraulic oil tank.

The control valve 172 is a spool valve which supplies hydraulic oil discharged from the main pump 14R to the traveling hydraulic motor 1R and discharges the hydraulic oil discharged from the traveling hydraulic motor 1R to the hydraulic oil tank.

The control valve 173 is a spool valve which supplies hydraulic oil discharged from the main pump 14L to the turning hydraulic motor 2A and discharges the hydraulic oil discharged from the turning hydraulic motor 2A to the hydraulic oil tank.

The control valve 174 is a spool valve which supplies hydraulic oil discharged from the main pump 14R to the bucket cylinder 9 and discharges the hydraulic oil in the bucket cylinder 9 to the hydraulic oil tank.

The control valves 175L and 175R are spool valves that supply the hydraulic oil discharged by the main pumps 14L and 14R to the boom cylinder 7, respectively, and discharge the hydraulic oil in the boom cylinder 7 to the hydraulic oil tank.

The control valves 176L and 176R supply the hydraulic oil discharged by the main pumps 14L and 14R to the arm cylinder 8, respectively, and discharge the hydraulic oil in the arm cylinder 8 to the hydraulic oil tank.

The control valves 171, 172, 173, 174, 175L, 175R, 176L, and 176R each adjust the flow rate of hydraulic oil supplied to and discharged from the hydraulic actuator and switch the direction of flow, depending on the pilot pressure acting on the pilot port.

The parallel oil line C2L supplies the hydraulic oil of the main pump 14L to the control valves 171, 173, 175L, and 176L in parallel with the center bypass oil line C1L. Specifically, the parallel oil line C2L branches from the center bypass oil line C1L at the upstream side of the control valve 171 and is configured to supply the hydraulic oil of the main pump 14L in parallel with each of the control valves 171, 173, 175L, and 176R. This allows the parallel oil line C2L to supply hydraulic oil to the control valve that is further downstream, when the flow of hydraulic oil passing through the center bypass oil line C1L is limited or blocked by one of the control valves 171, 173, and 175L.

The parallel oil line C2R supplies the hydraulic oil of the main pump 14R to the control valves 172, 174, 175R, and 176R in parallel with the center bypass oil line C1R. Specifically, the parallel oil line C2R branches from the center bypass oil line C1R at the upstream side of the control valve 172 and is configured to supply the hydraulic oil of the main pump 14R in parallel with each of the control valves 172, 174, 175R, and 176R. The parallel oil line C2R can supply hydraulic oil to a control valve further downstream when the flow of hydraulic oil passing through the center bypass oil line C1R is limited or blocked by one of the control valves 172, 174, and 175R.

The regulators 13L and 13R adjust the discharge amounts of the main pumps 14L and 14R by adjusting the tilt angles of the swash plates of the main pumps 14L and 14R, respectively, under the control of the controller 30.

The discharge pressure sensor 28L detects the discharge pressure of the main pump 14L, and a detection signal corresponding to the detected discharge pressure is incorporated into the controller 30. The same applies to the discharge pressure sensor 28R. Thus, the controller 30 can control the regulators 13L and 13R according to the discharge pressures of the main pumps 14L and 14R.

In the center bypass oil lines C1L and C1R, negative control diaphragms (hereinafter, "negative control diaphragms") 18L and 18R are provided between the control valves 176L and 176R, which are most downstream, and the hydraulic oil tank, respectively. Accordingly, the flow of hydraulic oil discharged by the main pumps 14L and 14R is limited by the negative control diaphragms 18L and 18R. The negative control diaphragms 18L and 18R generate a control pressure (hereinafter, "negative control pressure") for controlling the regulators 13L and 13R.

Negative control pressure sensors 19L and 19R detect the negative control pressure, and the detection signal corresponding to the detected negative control pressure is incorporated into the controller 30.

The controller 30 may control the regulators 13L and 13R according to the discharge pressures of the main pumps 14L and 14R detected by the discharge pressure sensors 28L and 28R to adjust the discharge amounts of the main pumps 14L and 14R. For example, the controller 30 may control the regulator 13L according to an increase in the discharge pressure of the main pump 14L to adjust the tilt angle of the swash plate of the main pump 14L to reduce the discharge amount. The same applies to the regulator 13R. Accordingly, the controller 30 can control the total horsepower of the main pumps 14L and 14R so that the suction horsepower of the main pumps 14L and 14R, which is expressed as the product of the discharge pressure and the discharge amount, does not exceed the output horsepower of the engine 11.

The controller 30 may adjust the discharge amount of the main pumps 14L and 14R by controlling the regulators 13L and 13R according to the negative control pressure detected by the negative control pressure sensors 19L and 19R. For example, the controller 30 decreases the discharge amount of the main pumps 14L and 14R as the negative control pressure increases, and increases the discharge amount of the main pumps 14L and 14R as the negative control pressure decreases.

Specifically, in the standby state in which none of the hydraulic actuators in the excavator 100 are operated (the state illustrated in FIG. 5), the hydraulic oil discharged from the main pumps 14L and 14R reaches the negative control diaphragms 18L and 18R through the center bypass oil lines C1L and C1R. The flow of hydraulic oil discharged from the main pumps 14L and 14R increases the negative control pressure generated upstream of the negative control diaphragms 18L and 18R. As a result, the controller 30 reduces the discharge amount of the main pumps 14L and 14R to the allowable minimum discharge amount and suppresses the pressure loss (pumping loss) when the discharged hydraulic oil passes through the center bypass oil lines C1L and C1R.

On the other hand, when any of the hydraulic actuators are operated, the hydraulic oil discharged from the main pumps 14L and 14R flows into the hydraulic actuator to be operated through a control valve corresponding to the hydraulic actuator to be operated. The flow of the hydraulic oil discharged from the main pumps 14L and 14R decreases or eliminates the amount reaching the negative control diaphragms 18L and 18R, thereby lowering the negative control pressure generated upstream of the negative control diaphragms 18L and 18R. As a result, the controller 30 can increase the discharge amount of the main pumps 14L and 14R, circulate sufficient hydraulic oil in the hydraulic actuator to be operated, and reliably drive the hydraulic actuator to be operated.

[Details of Configuration Relating to Machine Control Function in Hydraulic System of Excavator]

Figure 6A:
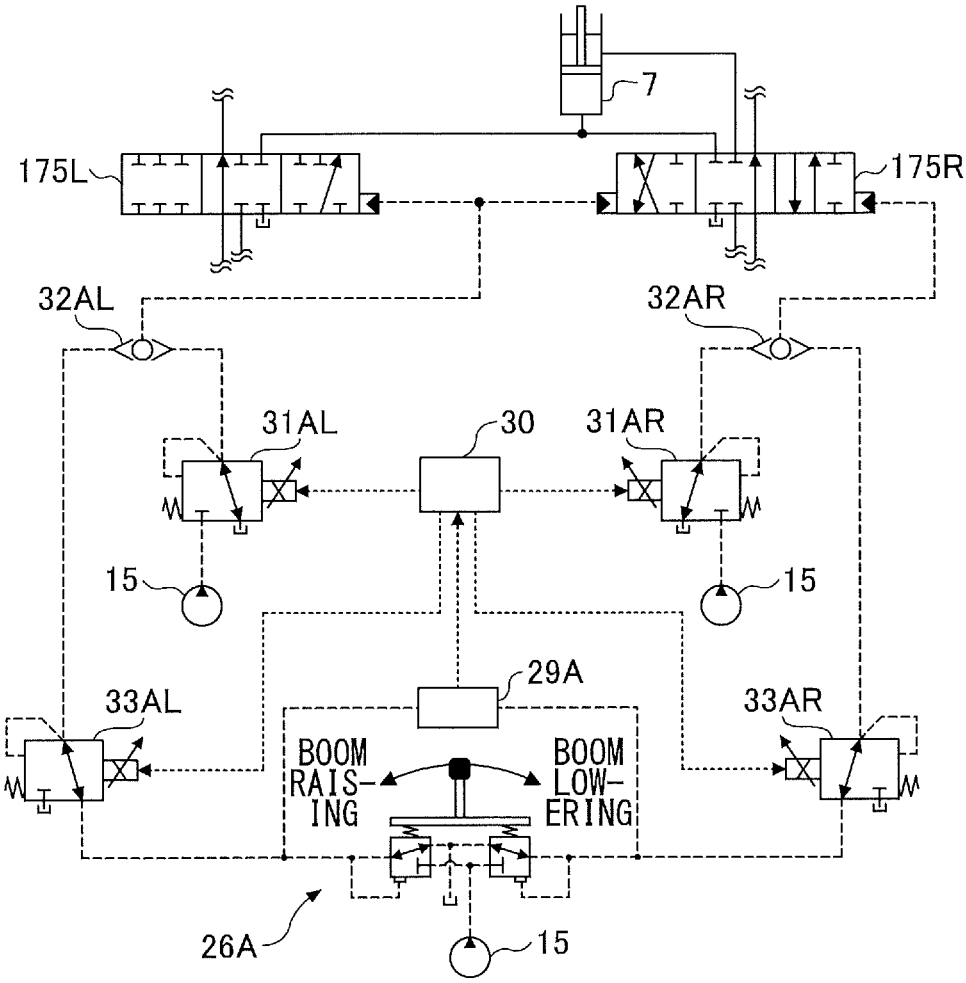
FIG. 6A is a diagram illustrating an example of components of an operation system for a boom in a hydraulic system of the excavator.
Figure 6B:
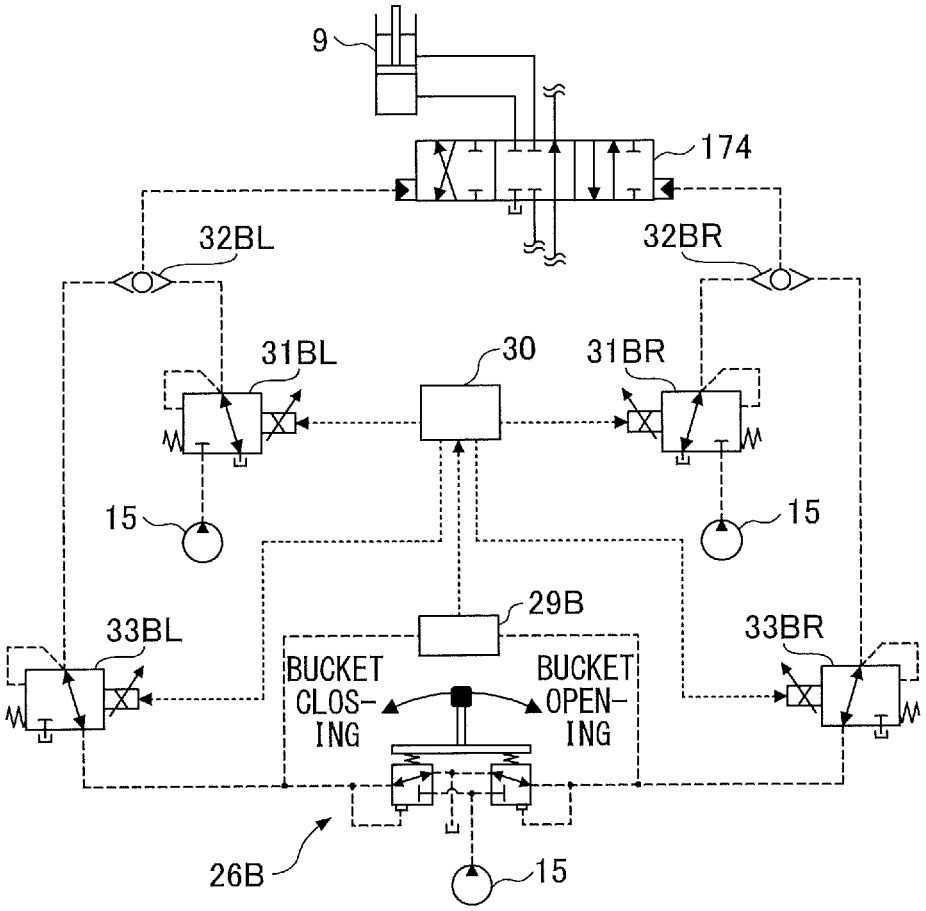
FIG. 6B is a diagram illustrating an example of components of an operation system for a bucket in the hydraulic system of the excavator.
Figure 6C:
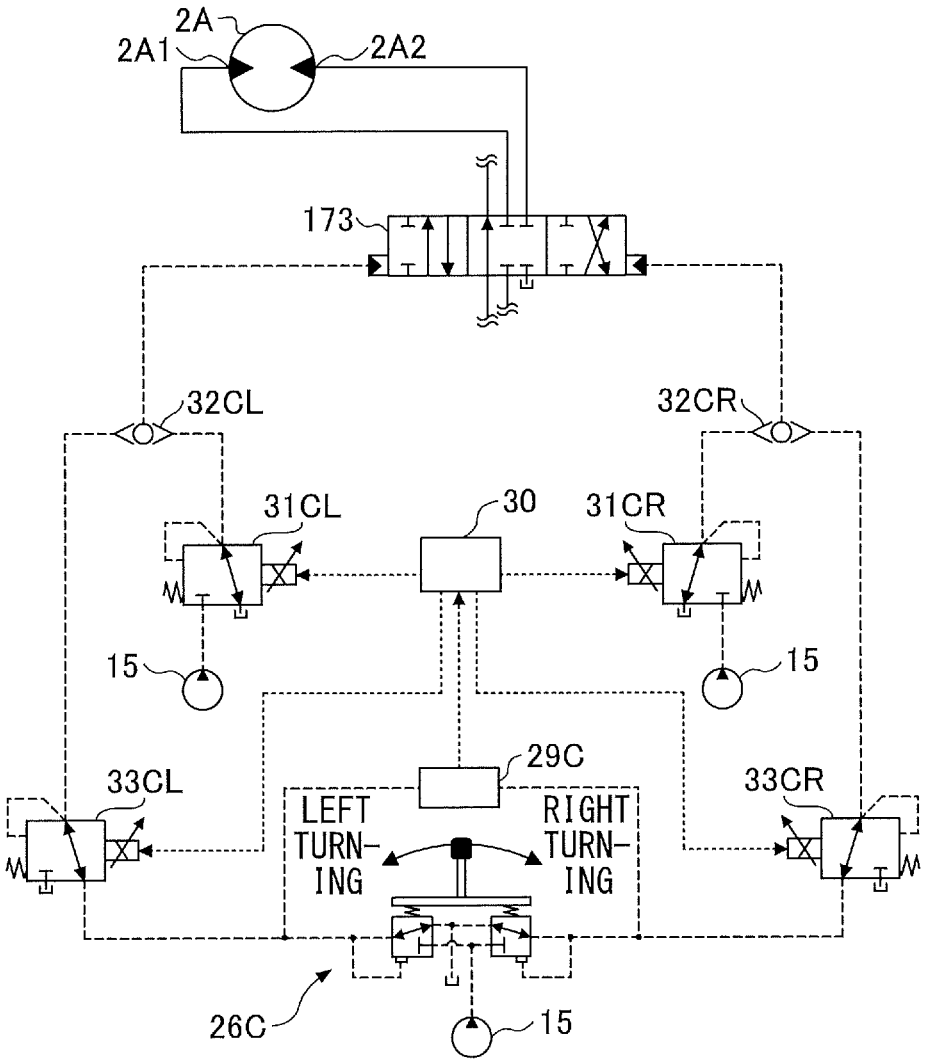
FIG. 6C is a diagram illustrating an example of components of an operation system for an upper turning body in the hydraulic system of the excavator.

Referring now to FIG. 6 (FIGS. 6A to 6C), a detailed description of the configuration regarding the machine control function in the hydraulic system of the excavator 100 will be provided.

FIGS. 6A to 6C schematically illustrate an example of the components of the operation system relating to the boom 4, the bucket 6, and the upper turning body 3 in the hydraulic system of the excavator 100 according to the present embodiment. Specifically, FIG. 6A illustrates an example of a pilot circuit for applying pilot pressure to the control valves 175L and 175R for hydraulic control of the boom cylinder 7. FIG. 6B is a diagram illustrating an example of a pilot circuit for applying pilot pressure to the control valve 174 for hydraulic control of the bucket cylinder 9. FIG. 6C is a diagram illustrating an example of a pilot circuit for applying pilot pressure to the control valve 173 for hydraulic control of the turning hydraulic motor 2A.

For example, as illustrated in FIG. 6A, the lever device 26A is used by an operator or the like to operate the boom cylinder 7 corresponding to the boom 4. The lever device 26A uses the hydraulic oil discharged from the pilot pump 15 to output the pilot pressure according to the operation content to the secondary side.

In the shuttle valve 32AL, one of two inlet ports is connected to a pilot line on the secondary side of the lever device 26A corresponding to an operation in the raising direction of the boom 4 (hereinafter, "boom raising operation") and the other one of the two inlet ports is connected to a pilot line on the secondary side of the proportional valve 31AL, and the outlet port is connected to the pilot port on the right side of the control valve 175L and to the pilot port on the left side of the control valve 175R.

In the shuttle valve 32AR, one of two inlet ports is connected to a pilot line on the secondary side of the lever device 26A corresponding to an operation in the lowering direction of the boom 4 (hereinafter, "boom lowering operation") and the other one of the two inlet ports is connected to a pilot line on the secondary side of the proportional valve 31AR, and the outlet port is connected to the pilot port on the right side of the control valve 175R.

That is, the lever device 26A applies a pilot pressure according to the operation content (for example, the operation direction and the operation amount), on the pilot ports of the control valves 175L, 175R through the shuttle valves 32AL, 32AR. Specifically, when the boom raising operation is performed, the lever device 26A outputs pilot pressure according to the amount of operation to one of the inlet ports of the shuttle valve 32AL and applies the pilot pressure on the pilot port on the right side of the control valve 175L and the pilot port on the left side of the control valve 175R through the shuttle valve 32AL. When the boom lowering operation is performed, the lever device 26A outputs a pilot pressure according to the amount of operation to one of the inlet ports of the shuttle valve 32AR and applies the pilot pressure on the pilot port on the right side of the control valve 175R through the shuttle valve 32AR.

The proportional valve 31AL operates in response to a control current input from the controller 30. Specifically, the proportional valve 31AL uses hydraulic oil discharged from the pilot pump 15 to output pilot pressure corresponding to the control current input from the controller 30 to the other inlet port of the shuttle valve 32AL. This allows the proportional valve 31AL to adjust the pilot pressure acting on the pilot port on the right side of the control valve 175L and the pilot port on the left side of the control valve 175R through the shuttle valve 32AL.

The proportional valve 31AR operates in response to a control current input from the controller 30. Specifically, the proportional valve 31AR uses hydraulic oil discharged from the pilot pump 15 to output pilot pressure corresponding to the control current input from the controller 30 to the other inlet port of the shuttle valve 32AR. This allows the proportional valve 31AR to adjust the pilot pressure acting on the pilot port on the right side of the control valve 175R through the shuttle valve 32AR.

That is, the proportional valves 31AL and 31AR can adjust the pilot pressure output to the secondary side so that the control valves 175L and 175R can be stopped at any valve position regardless of the operation state of the lever device 26A.

The proportional valve 33AL operates in response to a control current input from the controller 30. Specifically, when the control current from the controller 30 is not input, the proportional valve 33AL directly outputs the pilot pressure corresponding to the boom raising operation of the lever device 26A to the secondary side. On the other hand, when the control current from the controller 30 is input, the proportional valve 33AL decompresses the pilot pressure of the pilot line on the secondary side corresponding to the boom raising operation of the lever device 26A to a level corresponding to the control current, and outputs the decompressed pilot pressure to one of the inlet ports of the shuttle valve 32AL. Accordingly, the proportional valve 33AL can forcibly suppress or stop the motion of the boom cylinder 7 corresponding to the boom raising operation if necessary, even when a boom raising operation is performed with the lever device 26A. Further, the proportional valve 33AL can lower the pilot pressure acting on one of the inlet ports of the shuttle valve 32AL to a level lower than the pilot pressure acting on the other inlet port of the shuttle valve 32AL from the proportional valve 31AL, even when the lever device 26A is being used to perform a boom raising operation. Accordingly, the controller 30 controls the proportional valve 31AL and the proportional valve 33AL to ensure that the desired pilot pressure is applied to the pilot port on the boom raising side of the control valves 175L and 175R.

The proportional valve 33AR operates in response to a control current input from the controller 30. Specifically, when the control current from the controller 30 is not input, the proportional valve 33AR directly outputs the pilot pressure corresponding to the boom lowering operation of the lever device 26A to the secondary side. On the other hand, when the control current from the controller 30 is input, the proportional valve 33AR decompresses the pilot pressure on the pilot line on the secondary side corresponding to the boom lowering operation of the lever device 26A to a level corresponding to the control current, and outputs the decompressed pilot pressure to one of the inlet ports of the shuttle valve 32AR. Accordingly, the proportional valve 33AR can forcibly suppress or stop the motion of the boom cylinder 7 corresponding to the boom lowering operation if necessary, even when the lever device 26A is being used to perform a boom lowering operation. Further, the proportional valve 33AR can lower the pilot pressure acting on one of the inlet ports of the shuttle valve 32AR to a lower level than the pilot pressure acting on the other inlet port of the shuttle valve 32AR from the proportional valve 31AR, even when the lever device 26A is being used to perform a boom lowering operation. Accordingly, the controller 30 controls the proportional valve 31AR and the proportional valve 33AR to ensure that the desired pilot pressure is applied to the pilot port at the boom lowering side of the control valves 175L and 175R.

As described above, the proportional valves 33AL and 33AR can forcibly suppress or stop the motion of the boom cylinder 7 corresponding to the operation state of the lever device 26A. Further, the proportional valves 33AL and 33AR can decompress the pilot pressure acting on one of the inlet ports of the shuttle valves 32AL and 32AR and assist the pilot pressure of the proportional valves 31AL and 31AR to reliably act on the pilot port of the control valves 175L and 175R through the shuttle valves 32AL and 32AR.

The controller 30 may control the proportional valve 31AR instead of the proportional valve 33AL to forcibly suppress or stop the motion of the boom cylinder 7 corresponding to the boom raising operation of the lever device 26A. For example, when a boom raising operation is performed with the lever device 26A, the controller 30 may control the proportional valve 31AR to apply a predetermined pilot pressure on the pilot port at the boom lowering side of the control valves 175L and 175R from the proportional valve 31AR through the shuttle valve 32AR. As a result, the pilot pressure is applied to the pilot port at the boom lowering side of the control valves 175L and 175R in a manner so as to oppose against the pilot pressure acting on the pilot port at the boom raising side of the control valves 175L and 175R from the lever device 26A through the shuttle valve 32AL. Therefore, the controller 30 can forcibly bring the control valves 175L and 175R close to the neutral position to suppress or stop the motion of the boom cylinder 7 corresponding to the boom raising operation of the lever device 26A. Similarly, instead of controlling the proportional valve 33AR, the controller 30 may control the proportional valve 31AL to forcibly suppress or stop the motion of the boom cylinder 7 corresponding to the boom lowering operation of the lever device 26A.

The operation pressure sensor 29A detects the operation content with respect to the lever device 26A by the operator in the form of a pressure (operation pressure), and a detection signal corresponding to the detected pressure is incorporated into the controller 30. This allows the controller 30 to recognize the operation content with respect to the lever device 26A.

The controller 30 may cause the hydraulic oil discharged from the pilot pump 15 to be supplied to the pilot port on the right side of the control valve 175L and the pilot port on the left side of the control valve 175R through the proportional valve 31AL and the shuttle valve 32AL, regardless of the operator's boom raising operation with respect to the lever device 26A. Further, the controller 30 may supply hydraulic oil discharged from the pilot pump 15 to the pilot port on the right side of the control valve 175R through the proportional valve 31AR and the shuttle valve 32AR, regardless of the operator's boom lowering operation with respect to the lever device 26A. That is, the controller 30 can automatically control the raising and lowering motion of the boom 4, and implement the automatic operation function and the remote operation function, or the like, of the excavator 100.

As illustrated in FIG. 6B, the lever device 26B is used to operate the bucket cylinder 9 corresponding to the bucket 6 by the operator. The lever device 26B uses the hydraulic oil discharged from the pilot pump 15 to output the pilot pressure according to the operation content to the secondary side.

In the shuttle valve 32BL, one of two inlet ports is connected to the pilot line on the secondary side of the lever device 26B corresponding to an operation in the closing direction of the bucket 6 (hereinafter, "bucket closing operation") and the other one of the two inlet ports is connected to a pilot line on the secondary side of the proportional valve 31BL, and the outlet port is connected to the pilot port on the left side of the control valve 174.

In the shuttle valve 32BR, one of two inlet ports is connected to the pilot line on the secondary side of the lever device 26B corresponding to an operation in the opening direction of the bucket 6 (hereinafter, "bucket opening operation") and the other one of the two inlet ports is connected to a pilot line on the secondary side of the proportional valve 31BR, and the outlet port is connected to the pilot port on the right side of the control valve 174.

That is, the lever device 26B applies a pilot pressure according to the operation content, on the pilot port of the control valve 174 through the shuttle valves 32BL, 32BR. Specifically, when a bucket closing operation is performed, the lever device 26B outputs pilot pressure according to the amount of operation to one of the inlet ports of the shuttle valve 32BL to act on the pilot port on the left side of the control valve 174 through the shuttle valve 32BL. Further, when a bucket opening operation is performed, the lever device 26B outputs pilot pressure according to the amount of operation to one of the inlet ports of the shuttle valve 32BR to act on the pilot port on the right side of the control valve 174 through the shuttle valve 32BR.

The proportional valve 31BL operates in response to a control current input from the controller 30. Specifically, the proportional valve 31BL uses hydraulic oil discharged from the pilot pump 15 to output pilot pressure corresponding to the control current input from the controller 30 to the other pilot port of the shuttle valve 32BL. This allows the proportional valve 31BL to adjust the pilot pressure acting on the pilot port on the left side of the control valve 174 through the shuttle valve 32BL.

The proportional valve 31BR operates in response to the control current output by the controller 30. Specifically, the proportional valve 31BR uses hydraulic oil discharged from the pilot pump 15 to output pilot pressure corresponding to the control current input from the controller 30 to the other pilot port of the shuttle valve 32BR. This allows the proportional valve 31BR to adjust the pilot pressure acting on the pilot port on the right side of the control valve 174 through the shuttle valve 32BR.

That is, the proportional valves 31BL, 31BR can adjust the pilot pressure output to the secondary side so that the control valve 174 can be stopped at any valve position regardless of the operation state of the lever device 26B.

The proportional valve 33BL operates in response to a control current input from the controller 30. Specifically, when the control current from the controller 30 is not input, the proportional valve 33BL directly outputs the pilot pressure corresponding to the bucket closing operation of the lever device 26B to the secondary side. On the other hand, when the control current from the controller 30 is input, the proportional valve 33BL decompresses the pilot pressure of the pilot line on the secondary side corresponding to the bucket closing operation of the lever device 26B to a level corresponding to the control current, and outputs the decompressed pilot pressure to one of the inlet ports of the shuttle valve 32BL. Accordingly, the proportional valve 33BL can forcibly suppress or stop the motion of the bucket cylinder 9 corresponding to the bucket closing operation if necessary, even when the bucket closing operation is performed with the lever device 26B. Further, the proportional valve 33BL can lower the pilot pressure acting on one of the inlet ports of the shuttle valve 32BL to a level lower than the pilot pressure acting on the other inlet port of the shuttle valve 32BL from the proportional valve 31BL, even when the lever device 26B is being operated to perform a bucket closing operation. Thus, the controller 30 controls the proportional valve 31BL and the proportional valve 33BL to ensure that the desired pilot pressure is applied to the pilot port on the bucket closing side of the control valve 174.

The proportional valve 33BR operates in response to a control current input from the controller 30. Specifically, when the control current from the controller 30 is not input, the proportional valve 33BR directly outputs the pilot pressure corresponding to the bucket opening operation of the lever device 26B to the secondary side. On the other hand, when the control current from the controller 30 is input, the proportional valve 33BR decompresses the pilot pressure of the pilot line on the secondary side corresponding to the bucket opening operation of the lever device 26B to a level corresponding to the control current, and outputs the decompressed pilot pressure to one of the inlet ports of the shuttle valve 32BR. Accordingly, the proportional valve 33BR can forcibly suppress or stop the motion of the bucket cylinder 9 corresponding to the bucket opening operation if necessary, even when the lever device 26B is being operated to perform a bucket opening operation. Further, the proportional valve 33BR can lower the pilot pressure acting on one of the inlet ports of the shuttle valve 32BR to a level lower than the pilot pressure acting on the other inlet port of the shuttle valve 32BR from the proportional valve 31BR, even when the lever device 26B is being operated to perform a bucket opening operation. Accordingly, the controller 30 controls the proportional valve 31BR and the proportional valve 33BR to ensure that the desired pilot pressure is applied to the pilot port on the bucket opening side of the control valve 174.

As described above, the proportional valves 33BL and 33BR can forcibly suppress or stop the motion of the bucket cylinder 9 corresponding to the operation state of the lever device 26B in the left/right direction. Further, the proportional valves 33BL and 33BR can lower the pilot pressure acting on one of the inlet ports of the shuttle valves 32BL and 32BR to assist the pilot pressure of the proportional valves 31BL and 31BR to reliably act on the pilot port of the control valve 174 through the shuttle valves 32BL and 32BR.

Instead of controlling the proportional valve 33BL, the controller 30 may control the proportional valve 31BR to forcibly suppress or stop the motion of the bucket cylinder 9 corresponding to the bucket closing operation of the lever device 26B. For example, when a bucket closing operation is performed with the lever device 26B, the controller 30 may control the proportional valve 31BR to apply a predetermined pilot pressure on the pilot port on the bucket opening side of the control valve 174 through the shuttle valve 32BR from the proportional valve 31BR. As a result, the pilot pressure is applied to the pilot port on the bucket opening side of the control valve 174 in a manner so as to oppose against the pilot pressure acting on the pilot port on the bucket closing side of the control valve 174 from the lever device 26B through the shuttle valve 32BL. Accordingly, the controller 30 may forcibly bring the control valve 174 close to the neutral position to suppress or stop the motion of the bucket cylinder 9 corresponding to the bucket closing operation of the lever device 26B. Similarly, instead of controlling the proportional valve 33BR, the controller 30 may control the proportional valve 31BL to forcibly suppress or stop the motion of the bucket cylinder 9 corresponding to the bucket opening operation of the lever device 26B.

The operation pressure sensor 29B detects the operation content with respect to the lever device 26B by the operator in the form of pressure (operation pressure) and a detection signal corresponding to the detected pressure is incorporated into the controller 30. This allows the controller 30 to recognize the operation content in the left/right direction with respect to the lever device 26B.

The controller 30 may cause the hydraulic oil discharged from the pilot pump 15 to be supplied to the pilot port on the left side of the control valve 174 through the proportional valve 31BL and the shuttle valve 32BL, regardless of the operator's bucket closing operation with respect to the lever device 26B. Further, the controller 30 may cause the hydraulic oil discharged from the pilot pump 15 to be supplied to the pilot port on the right side of the control valve 174 through the proportional valve 31BR and the shuttle valve 32BR, regardless of the operator's bucket opening operation with respect to the lever device 26B. That is, the controller 30 can automatically control the opening and closing motion of the bucket 6, and implement the automatic operation function and the remote operation function, or the like, of the excavator 100.

Further, for example, as illustrated in FIG. 6C, the lever device 26C is used to operate the turning hydraulic motor 2A corresponding to the upper turning body 3 (the turning mechanism 2) by the operator. The lever device 26C uses the hydraulic oil discharged from the pilot pump 15 to output a pilot pressure according to the operation content to the secondary side.

In the shuttle valve 32CL, one of two inlet ports is connected to a pilot line on the secondary side of the lever device 26C corresponding to a turning operation in the left direction of the upper turning body 3 (hereinafter, "left turning operation") and the other one of the two inlet ports is connected to a pilot line on the secondary side of the proportional valve 31CL, and the outlet port is connected to the pilot port on the left side of the control valve 173.

In the shuttle valve 32CR, one of two inlet ports is connected to the pilot line on the secondary side of the lever device 26C corresponding to a turning operation in the right direction of the upper turning body 3 (hereinafter, "right turning operation") and the other one of the two inlet ports is connected to a pilot line on the secondary side of the proportional valve 31CR, and the outlet port is connected to the pilot port on the right side of the control valve 173.

That is, the lever device 26C applies a pilot pressure according to the operation content, on the pilot port of the control valve 173 through the shuttle valves 32CL, 32CR. Specifically, when a left turning operation is performed, the lever device 26C outputs pilot pressure according to the amount of operation to one of the inlet ports of the shuttle valve 32CL to act on the pilot port on the left side of the control valve 173 through the shuttle valve 32CL. Further, when a right turning operation is performed, the lever device 26C outputs pilot pressure according to the amount of operation to one of the inlet ports of the shuttle valve 32CR to act on the pilot port on the right side of the control valve 173 through the shuttle valve 32CR.

The proportional valve 31CL operates in response to a control current input from the controller 30. Specifically, the proportional valve 31CL uses hydraulic oil discharged from the pilot pump 15 to output pilot pressure corresponding to the control current input from the controller 30 to the other pilot port of the shuttle valve 32CL. This allows the proportional valve 31CL to adjust the pilot pressure acting on the pilot port on the left side of the control valve 173 through the shuttle valve 32CL.

The proportional valve 31CR operates in response to the control current output by the controller 30. Specifically, the proportional valve 31CR uses hydraulic oil discharged from the pilot pump 15 to output pilot pressure corresponding to the control current input from the controller 30 to the other pilot port of the shuttle valve 32CR. This allows the proportional valve 31CR to adjust the pilot pressure acting on the pilot port on the right side of the control valve 173 through the shuttle valve 32CR.

That is, the proportional valves 31CL, 31CR can adjust the pilot pressure output to the secondary side so that the control valve 173 can be stopped at any valve position regardless of the operation state of the lever device 26C.

The proportional valve 33CL operates in response to a control current input from the controller 30. Specifically, when the control current from the controller 30 is not input, the proportional valve 33CL directly outputs the pilot pressure corresponding to the left turning operation of the lever device 26C to the secondary side. On the other hand, when the control current from the controller 30 is input, the proportional valve 33CL decompresses the pilot pressure of the pilot line on the secondary side corresponding to the left turning operation of the lever device 26C to a level corresponding to the control current, and outputs the decompressed pilot pressure to one of the inlet ports of the shuttle valve 32CL. Accordingly, the proportional valve 33CL can forcibly suppress or stop the motion of the turning hydraulic motor 2A corresponding to the left turning operation if necessary, even when the left turning operation is performed with the lever device 26C. Further, the proportional valve 33CL can lower the pilot pressure acting on one of the inlet ports of the shuttle valve 32CL to a level lower than the pilot pressure acting on the other inlet port of the shuttle valve 32CL from the proportional valve 31CL, even when the lever device 26C is being operated to perform a left turning operation. Thus, the controller 30 controls the proportional valve 31CL and the proportional valve 33CL to ensure that the desired pilot pressure is applied to the pilot port on the left turning side of the control valve 173.

The proportional valve 33CR operates in response to a control current input from the controller 30. Specifically, when the control current from the controller 30 is not input, the proportional valve 33CR directly outputs the pilot pressure corresponding to the right turning operation of the lever device 26C to the secondary side. On the other hand, when the control current from the controller 30 is input, the proportional valve 33CR decompresses the pilot pressure of the pilot line on the secondary side corresponding to the right turning operation of the lever device 26C to a level corresponding to the control current, and outputs the decompressed pilot pressure to one of the inlet ports of the shuttle valve 32CR. Accordingly, the proportional valve 33CR can forcibly suppress or stop the motion of the turning hydraulic motor 2A corresponding to the right turning operation if necessary, even when the lever device 26C is being operated to perform a right turning operation. Further, the proportional valve 33CR can lower the pilot pressure acting on one of the inlet ports of the shuttle valve 32CR to a level lower than the pilot pressure acting on the other inlet port of the shuttle valve 32CR from the proportional valve 31CR, even when the lever device 26C is being operated to perform a right turning operation. Accordingly, the controller 30 controls the proportional valve 31CR and the proportional valve 33CR to ensure that the desired pilot pressure is applied to the pilot port on the right turning side of the control valve 173.

As described above, the decompression proportional valves 33CL and 33CR can forcibly suppress or stop the motion of the turning hydraulic motor 2A corresponding to the operation state of the lever device 26C in the left/right direction. Further, the decompression proportional valves 33CL and 33CR can lower the pilot pressure acting on one of the inlet ports of the shuttle valves 32CL and 32CR to assist the pilot pressure of the proportional valves 31CL and 31CR to reliably act on the pilot port of the control valve 173 through the shuttle valves 32CL and 32CR.

Instead of controlling the proportional valve 33CL, the controller 30 may control the proportional valve 31CR to forcibly suppress or stop the motion of the turning hydraulic motor 2A corresponding to the left turning operation of the lever device 26C. For example, when a left turning operation is performed with the lever device 26C, the controller 30 may control the proportional valve 31CR to apply a predetermined pilot pressure on the pilot port on the right turning side of the control valve 173 through the shuttle valve 32CR from the proportional valve 31CR. As a result, the pilot pressure is applied to the pilot port on the right turning side of the control valve 173 in a manner so as to oppose against the pilot pressure acting on the pilot port on the left turning side of the control valve 173 from the lever device 26C through the shuttle valve 32CL. Accordingly, the controller 30 may forcibly bring the control valve 173 close to the neutral position to suppress or stop the motion of the turning hydraulic motor 2A corresponding to the left turning operation of the lever device 26C. Similarly, instead of controlling the proportional valve 33CR, the controller 30 may control the proportional valve 31CL to forcibly suppress or stop the motion of the turning hydraulic motor 2A corresponding to the right turning operation of the lever device 26C.

The operation pressure sensor 29C detects the operation state with respect to the lever device 26C by the operator as pressure and a detection signal corresponding to the detected pressure is incorporated into the controller 30. This allows the controller 30 to recognize the operation content with respect to the lever device 26C.

The controller 30 may cause the hydraulic oil discharged from the pilot pump 15 to be supplied to the pilot port on the left side of the control valve 173 through the proportional valve 31CL and the shuttle valve 32CL, regardless of the operator's left turning operation with respect to the lever device 26C. Further, the controller 30 may cause the hydraulic oil discharged from the pilot pump 15 to be supplied to the pilot port on the right side of the control valve 173 through the proportional valve 31CR and the shuttle valve 32CR, regardless of the operator's right turning operation with respect to the lever device 26C. That is, the controller 30 can automatically control the turning motion of the upper turning body 3 in the right/left direction, and implement the automatic operation function and the remote operation function, or the like, of the excavator 100.

The excavator 100 may further include a configuration in which the arm 5 is automatically opened and closed and a configuration in which the lower traveling body 1 is automatically moved forward and backward. In this case, in the hydraulic system, a component relating to an operation system of the arm cylinder 8, a component relating to an operation system of the traveling hydraulic motor 1L, and a component relating to an operation system of the traveling hydraulic motor 1R may be configured in the same manner as the component relating to the operation system of the boom cylinder 7 (FIGS. 6A to 6C). Thus, the controller 30 outputs the control current to the corresponding proportional valve 31 or the proportional valve 33 and automatically controls the motion of the arm 5 and the traveling motion of the lower traveling body 1, thereby implementing the automatic operation function and the remote operation function of the excavator 100.

[Front-Facing Process]

Next, a control process in which the upper turning body 3 is caused to front-face the target work surface by the controller 30 (hereinafter, a "front-facing process") will be described with reference to FIGS. 7 to 11.

<Example of Front-Facing Process>

Figure 7:
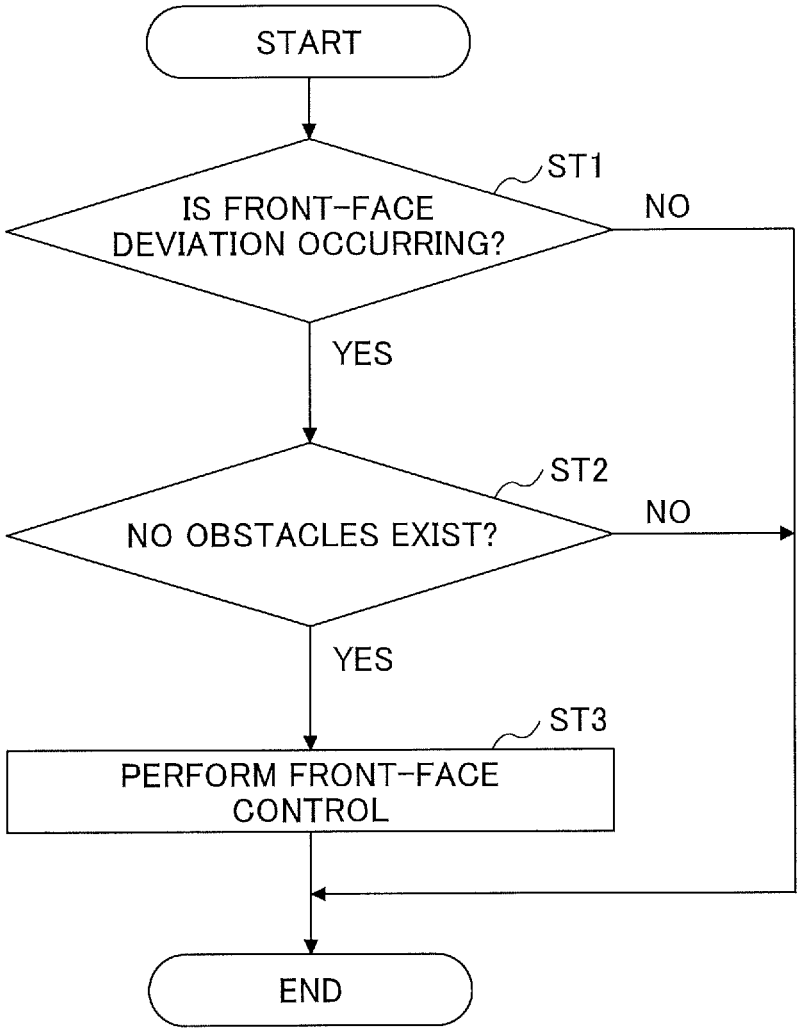
FIG. 7 is a flowchart schematically illustrating an example of a front-facing process by a controller of the excavator.
Figure 8A:
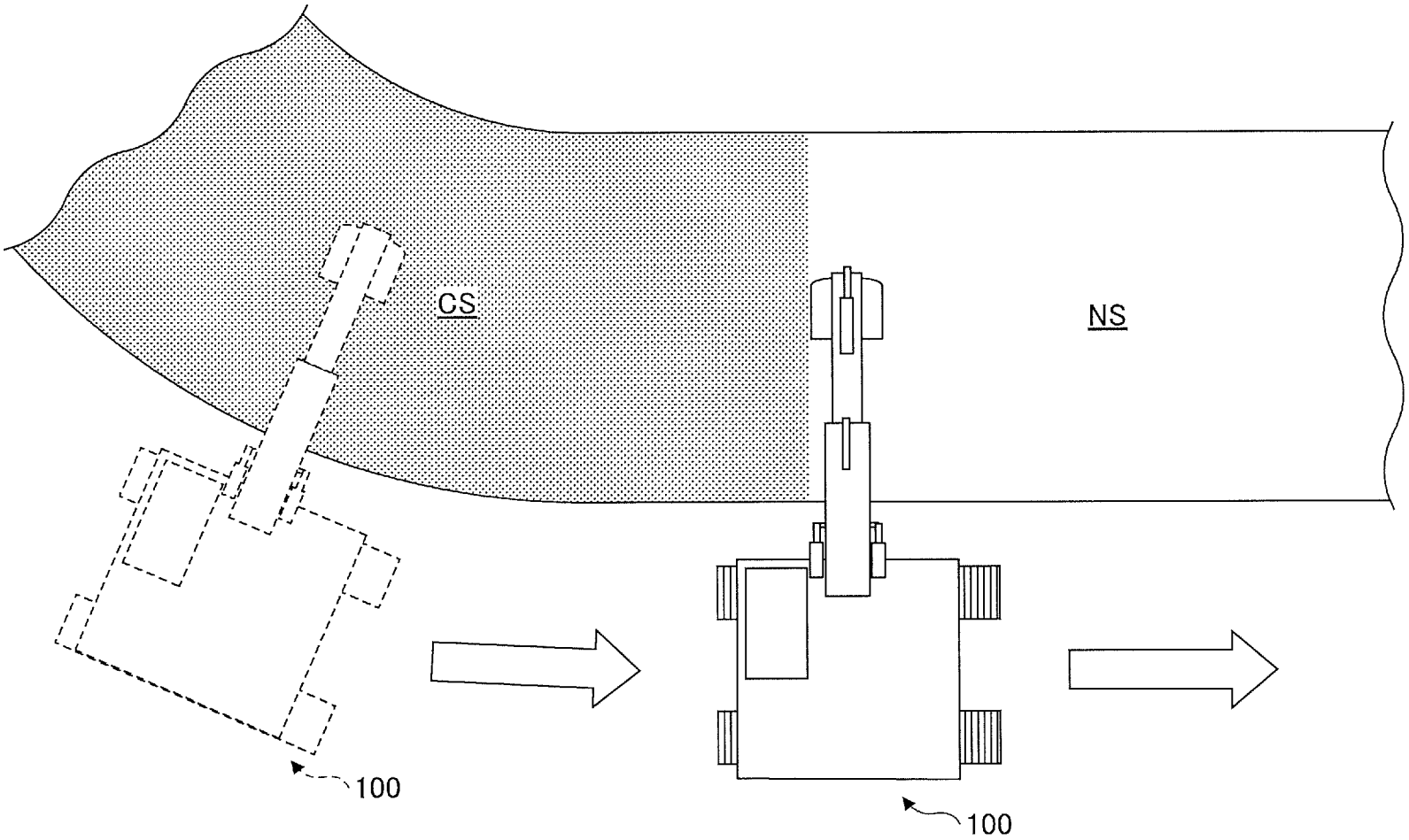
FIG. 8A is a top view illustrating an example of a motion step of the excavator when the front-facing process is performed.
Figure 8B:
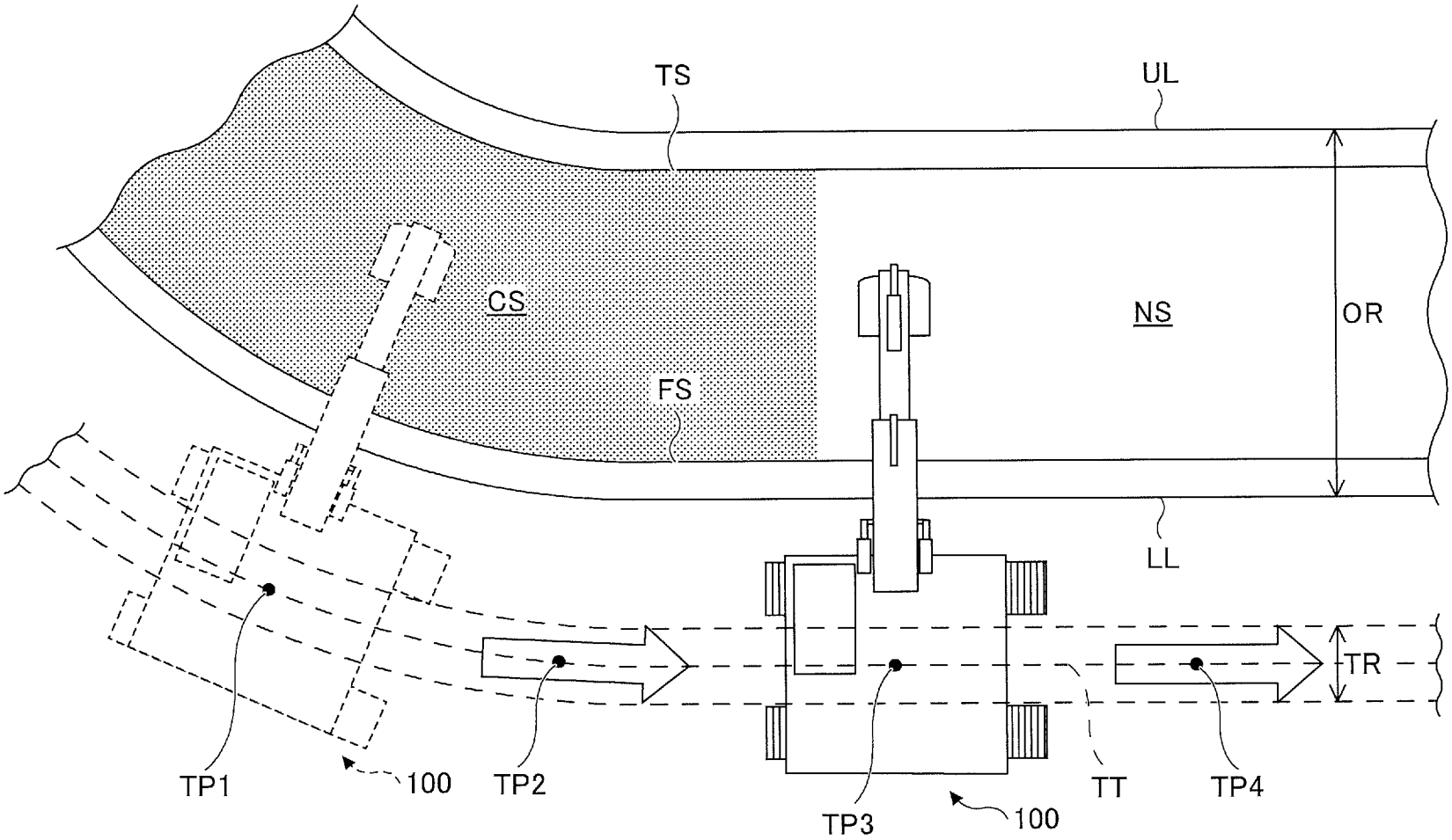
FIG. 8B is a top view illustrating an example of a motion step of the excavator when the front-facing process is performed.
Figure 9:
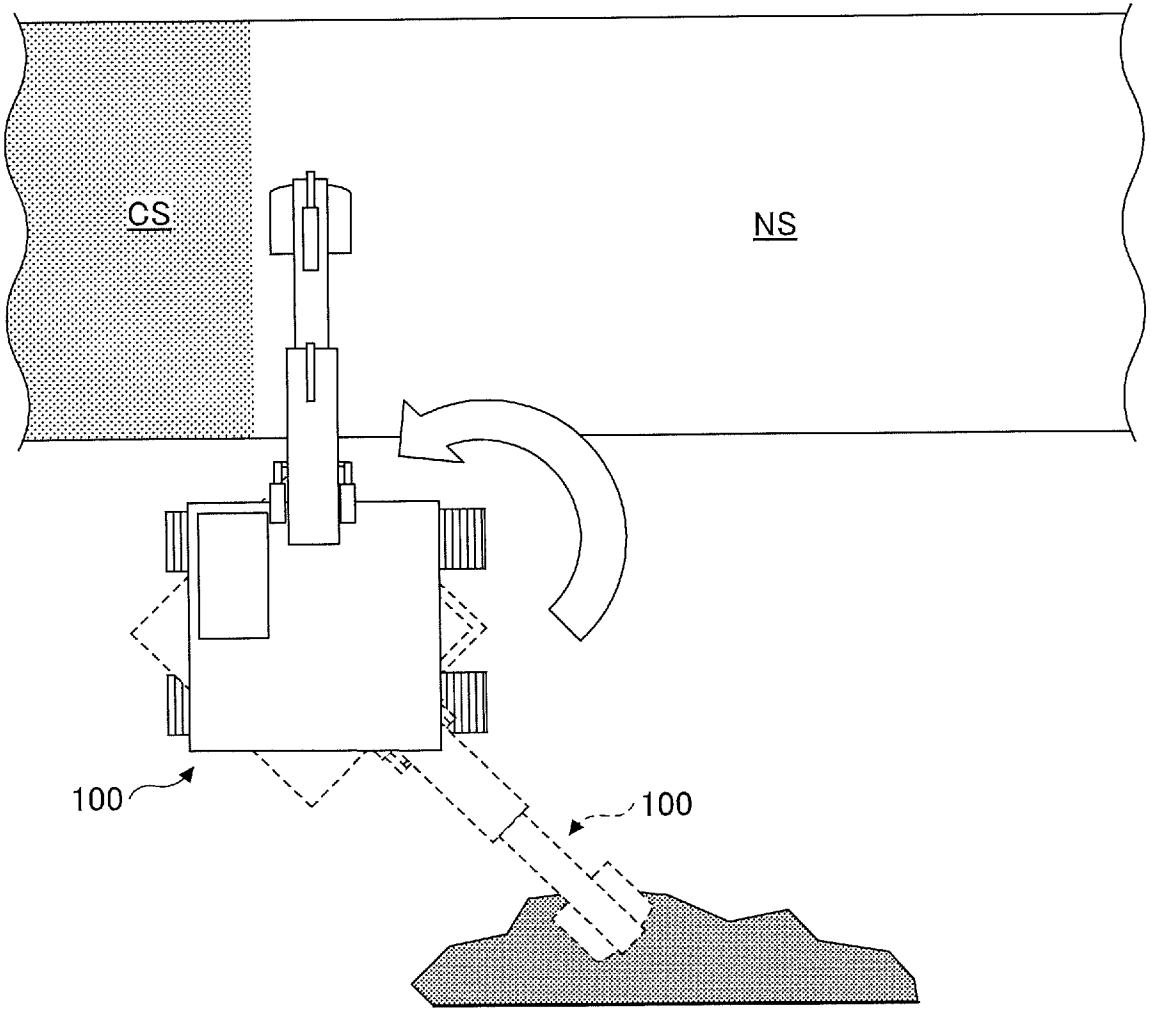
FIG. 9 is a top view illustrating another example of a motion step of the excavator when a front-facing process is performed.

FIG. 7 is a flowchart illustrating an example of a front-facing process by the controller 30 of the excavator 100 according to the present embodiment. FIGS. 8 (8A, 8B) and 9 are diagrams illustrating one example and another example of an excavator motion step when a front-facing process is performed. Specifically, FIGS. 8A and 8B illustrate a motion step (hereinafter, "parallel movement step") in which the excavator 100 moves from the work completion area CS to a position facing the work uncompleted area NS along the orientation of the target work surface (i.e., the direction in which the target work surface extends) in order to move toward the next work position when the work on the upward tilt surface ES in front of the excavator 100 is completed. FIG. 9 is a diagram illustrating a motion step (hereinafter, a "soil discharging step") in which the excavator 100 performs a turning motion in a direction away from the target work surface during work on the target work surface, discharges the soil, or the like, contained in the bucket 6 to a position away from the upward tilt surface ES that is the work target, and then performs a turning motion in a direction to come near the target work surface to resume work on the target work surface.

For example, when the MC switch or the like is pushed down and the upper turning body 3 is not turning in a direction in which the attachment moves away from the target work surface, the front-facing process according to the flowchart illustrated in FIG. 7 is repeatedly performed for each predetermined processing cycle. At this time, as described above, for example, the controller 30 can determine whether the attachment is moving toward or away from the target work surface based on whether the moving direction is such that the vertical distance between the claw tip of the bucket 6 and the target work surface (the upward slope) is increasing.

In step ST1, the machine guidance unit 50 determines whether a front-face deviation is occurring. For example, the machine guidance unit 50 determines whether a front-face deviation is occurring based on the information on the target work surface stored in advance in the storage device 47 and the output of the positioning device P1 as the orientation detecting device. Information on the target work surface includes information on the orientation of the target work surface (that is, the direction in which the target work surface extends). The positioning device P1 outputs information on the orientation of the upper turning body 3. Specifically, as illustrated in FIG. 4A, for example, the machine guidance unit 50 determines that a front-face deviation is occurring between the target work surface and the upper turning body 3 of the excavator 100 when the operation plane AF of the attachment does not include the normal line of the target work surface. That is, the state in which a front-face deviation is occurring between the target work surface and the upper turning body 3 of the excavator 100 corresponds to a state in which the angle formed between the line segment representing the orientation of the target work surface and the line segment representing the orientation of the upper turning body 3, that is, the line segment representing the front-back axis of the upper turning body 3, is not 90 degrees. Accordingly, the machine guidance unit 50 may determine whether there is a front-face deviation based on an angle formed between a line segment representing the orientation of the target work surface and a line segment representing the orientation of the upper turning body 3. The machine guidance unit 50 proceeds to step ST2 when there is a front-face deviation, and ends the current process when there is no front-face deviation.

In step ST2, the machine guidance unit 50 determines whether an obstacle exists around the excavator 100. For example, the machine guidance unit 50 performs a predetermined image recognition process on an image captured by the imaging device S6 to determine whether an image relating to a predetermined obstacle exists in the captured image. In this case, predetermined obstacles include, for example, humans, animals, other work machines, buildings, site materials, and the like. Then, the machine guidance unit 50 determines that there is no obstacle around the excavator 100 when it is determined that there is no image relating to a predetermined obstacle in the image of a predetermined range set around the excavator 100. In this case, the predetermined range is the range in which an object that may contact the excavator 100 exists, for example, when the excavator 100 is moved to make the upper turning body 3 front-face the target work surface, and the range is defined in advance.

In step ST3, the machine guidance unit 50 performs front-face control. For example, when the upper turning body 3 turns in the left direction so that the upper turning body 3 is caused to front-face the target work surface, the machine guidance unit 50 (the automatic control unit 54) outputs a control command (for example, a control current as a current command) to the proportional valve 31CL (see FIG. 6C). Accordingly, the proportional valve 31CL uses the hydraulic oil supplied from the pilot pump 15 to generate pilot pressure corresponding to the control current and causes the pilot pressure to act on the left pilot port of the control valve 173 via the shuttle valve 32CL. The control valve 173, which has received the pilot pressure at the left pilot port, shifts in the right direction to cause the hydraulic oil discharged by the main pump 14L to flow into a first port 2A1 of the turning hydraulic motor 2A and to cause the hydraulic oil discharged from a second port 2A2 to flow out into the hydraulic oil tank. As a result, the turning hydraulic motor 2A rotates in the forward direction to cause the upper turning body 3 to turn in the left direction about the turning axis. Thereafter, when it is determined that the excavator 100 front-faces the target work surface, the automatic control unit 54 suspends the output of the control current for the proportional valve 31CL and reduces the pilot pressure acting on the left pilot port of the control valve 173. When the pilot pressure acting on the left pilot port is reduced, the control valve 173 shifts to the left and returns to a neutral position, blocking the flow of hydraulic oil from the main pump 14L to the first port 2A1 of the turning hydraulic motor 2A and blocking the flow of hydraulic oil from the second port 2A2 to the hydraulic oil tank. As a result, the turning hydraulic motor 2A stops the forward rotation and stops the left turning of the upper turning body 3. The same shall apply to the case where the upper turning body 3 is turned in the right direction. Thus, the machine guidance unit 50 can cause the upper turning body 3 of the excavator 100 to be in a state of front-facing the target work surface.

As described above, in the present embodiment, the controller 30 (the machine guidance unit 50) repeats the front-facing process when, for example, the MC switch is pressed down and the upper turning body 3 is not turning away from the target work surface. That is, the controller 30 maintains the state in which the excavator 100 is front-facing the target work surface when the machine control function is enabled and the upper turning body 3 is not turning away from the target work surface. Accordingly, the controller 30 can automatically maintain the state in which the upper turning body 3 is front-facing the target work surface even when various motion elements (such as the lower traveling body 1, the upper turning body 3, the boom 4, the arm 5, and the bucket 6) are operated.

For example, when the excavator 100 is operating the attachment for working on the target work surface in accordance with the arm operation by an operator using the machine control function, the posture of the machine may be distorted depending on the state of the ground where the lower traveling body 1 is located.

On the other hand, in the present embodiment, when the attachment is operated (i.e., the attachment is driven by at least one of the boom cylinder 7, the arm cylinder 8, and the bucket cylinder 9), the controller 30 performs front-face control so that the upper turning body 3 remains in a state front-facing the target work surface. This allows the controller 30 to maintain the front-facing state of the upper turning body 3 with respect to the target work surface during operation of the attachment. Therefore, the excavator 100 can more appropriately perform the work on the target work surface. Further, the excavator 100 can maintain the front-facing state of the upper turning body 3 with respect to the target work surface without requiring the operation by an operator or the like, thereby reducing burden felt by the operator or the like.

Further, for example, as illustrated in FIGS. 8A and 8B, the target work surface may be curved in a planar view, i.e., the orientation of the target work surface may vary depending on the location. In such a case, in the parallel movement step of the excavator 100, it is necessary for the operator or the like to perform manual operation so that the movement direction of the lower traveling body 1 matches the change in the orientation of the target work surface. Therefore, even though the front-facing state of the upper turning body 3 with respect to the target work surface is established at a position before starting the movement of the excavator 100, the upper turning body 3 is likely to fall out of the front-facing state by the movement. Further, even when the orientation of the target work surface is not changed, it is not easy to completely match the movement direction of the lower traveling body 1 with the orientation of the target work surface, and as a result, the upper turning body 3 may fall out of the front-facing state with respect to the target work surface.

On the other hand, according to the present embodiment, when the lower traveling body 1 is operated (that is, when the lower traveling body 1 is driven by at least one of the two traveling hydraulic motors 1A and 1B), specifically, when the lower traveling body 1 is moving (traveling) in parallel along the orientation of the target work surface, the controller 30 performs front-face control so that the upper turning body 3 remains in a state front-facing the target work surface. Accordingly, the controller 30 can maintain a front-facing state of the upper turning body 3 with respect to the target work surface when the lower traveling body 1 travels. Therefore, even when the orientation of the target work surface varies depending on the location as illustrated in FIGS. 8A and 8B or when the movement direction of the lower traveling body 1 cannot be adjusted to match the orientation of the target work surface, the excavator 100 can carry out parallel movement after completion of the work at a certain position and maintain the front-facing state of the upper turning body 3 with respect to the target work surface at all times in repeating the step of starting the work again. Further, the excavator 100 maintains the front-facing state of the upper turning body 3 with respect to the target work surface without requiring an operation by an operator or the like during the parallel movement step of the excavator 100, thereby reducing burden felt by an operator or the like.

Further, for example, in a control mode in which, after a parallel movement, front-face control is performed after arriving at the next work location, a waiting time until the front-face control is completed at the next work location may occur. In the present embodiment, such a waiting time can be reduced.

As illustrated in FIG. 8B, the controller 30 may control the travel trajectory of the excavator 100 in addition to the front-face control in the parallel movement step of the excavator 100.

The controller 30 may generate a target of the travel trajectory (hereinafter, "travel target trajectory") TT of the lower traveling body 1 based on the target work surface. The travel trajectory of the lower traveling body 1 may be a trajectory drawn by a predetermined portion of the lower traveling body 1 as the lower traveling body 1 travels. Specifically, the controller 30 may generate the travel target trajectory TT such that the working portion of the bucket 6 can be moved along the target work surface from a top of slope TS to a toe of slope FS. Further, the travel target trajectory TT may be generated between the work start position and the work end position of the slope to be worked on. For example, the controller 30 may generate the travel target trajectory TT such that the top of slope TS and the toe of slope FS of the target work surface are included between an upper limit UL and a lower limit LL of a range OR (the "Att operable range") in which the leading end of the attachment AT (the working portion of the bucket 6) can operate along the tilt of the target work surface. Accordingly, the excavator 100 can move the leading end of the attachment AT (the working portion of the bucket 6) along the target work surface across the entire range from the top of slope TS to the toe of slope FS, regardless of the work location to where traveling is performed. Therefore, the workability of the slope work by the excavator 100 can be improved.

The controller 30, for example, sets intermediate target positions TP1 to TP4 corresponding to the locations where the excavator 100 is to perform work along the travel target trajectory TT from the work start position to the work end position of the slope to be worked on. Then, the controller 30 automatically controls the crawlers 1CL and 1CR to travel along the travel target trajectory TT, for example, from an intermediate position corresponding to the present work location to an intermediate position corresponding to the next work location, according to the traveling operation by the operator. Specifically, the controller 30 controls the proportional valve 31 corresponding to the control valves 171 and 172 that drive traveling hydraulic motors 2ML and 2MR to implement the automatic operation function (machine control function) of the lower traveling body 1.

Further, the controller 30 may set a tolerance range of errors (hereinafter, "error tolerance range") TR with respect to the travel target trajectory TT. For example, if the surface of the road in the construction site has relatively large irregularities, even if the control is performed with relatively high accuracy, it is not necessarily possible to travel along the travel target trajectory TT. Specifically, the controller 30 may set the error tolerance range TR based on the positional relationship between the Att operable range OR corresponding to the travel target trajectory TT and the top of slope TS and the toe of slope FS of the target work surface. This allows the controller 30 to control the traveling trajectory of the excavator 100 such that the top of slope TS and the toe of slope FS fit within the Att operable range OR while allowing some error from the travel target trajectory TT.

For example, as illustrated in FIG. 9, when starting work at a certain location, even though the front-facing state of the upper turning body 3 with respect to the target work surface is established, the upper turning body 3 may fall out of the front-facing state when the soil discharging step is performed. Therefore, at the end of the soil discharging step, it becomes necessary for the operator or the like to have the upper turning body 3 front-face the target work surface again.

On the other hand, in the present embodiment, the controller 30 starts the front-face control when the upper turning body 3 turns in a direction to come near the target work surface (the turning operation starts) in accordance with an operator's turning operation after the soil or the like of the bucket 6 is discharged, that is, when the upper turning body 3 is operated to turn in a direction such that the upper turning body 3 comes near the target work surface. That is, in the soil discharging step, the excavator 100 attempts to maintain the state where the upper turning body 3 is front-facing the target work surface, except for when the upper turning body 3 turns in a direction away from the target work surface or when the soil discharging step is subsequently performed, that is, when an operation is performed which is not intended to maintain the front-facing state of the upper turning body 3 with respect to the target work surface. Therefore, as illustrated in FIG. 9, in the soil discharging step, even when the upper turning body 3 turns in the direction to move away from the target work surface and the upper turning body 3 falls out of the front-facing state with respect to the target work surface, the excavator 100 can cause the upper turning body 3 to return to the front-facing state with respect to the target work surface again. Further, during a turning operation in a direction where the upper turning body 3 comes near the target work surface, the excavator 100 supports the operation by an operator or the like to cause the upper turning body 3 to front-face the target work surface, and therefore, burden felt by the operator or the like can be reduced.

Further, for example, in a control mode in which, after the soil discharging step is completed, the turning operation of the upper turning body 3 is stopped and front-face control is performed, a waiting time until the construction work is restarted may occur. However, in the present embodiment, such a waiting time can be reduced.

<Another Example of Front-Facing Process>

Figure 10:
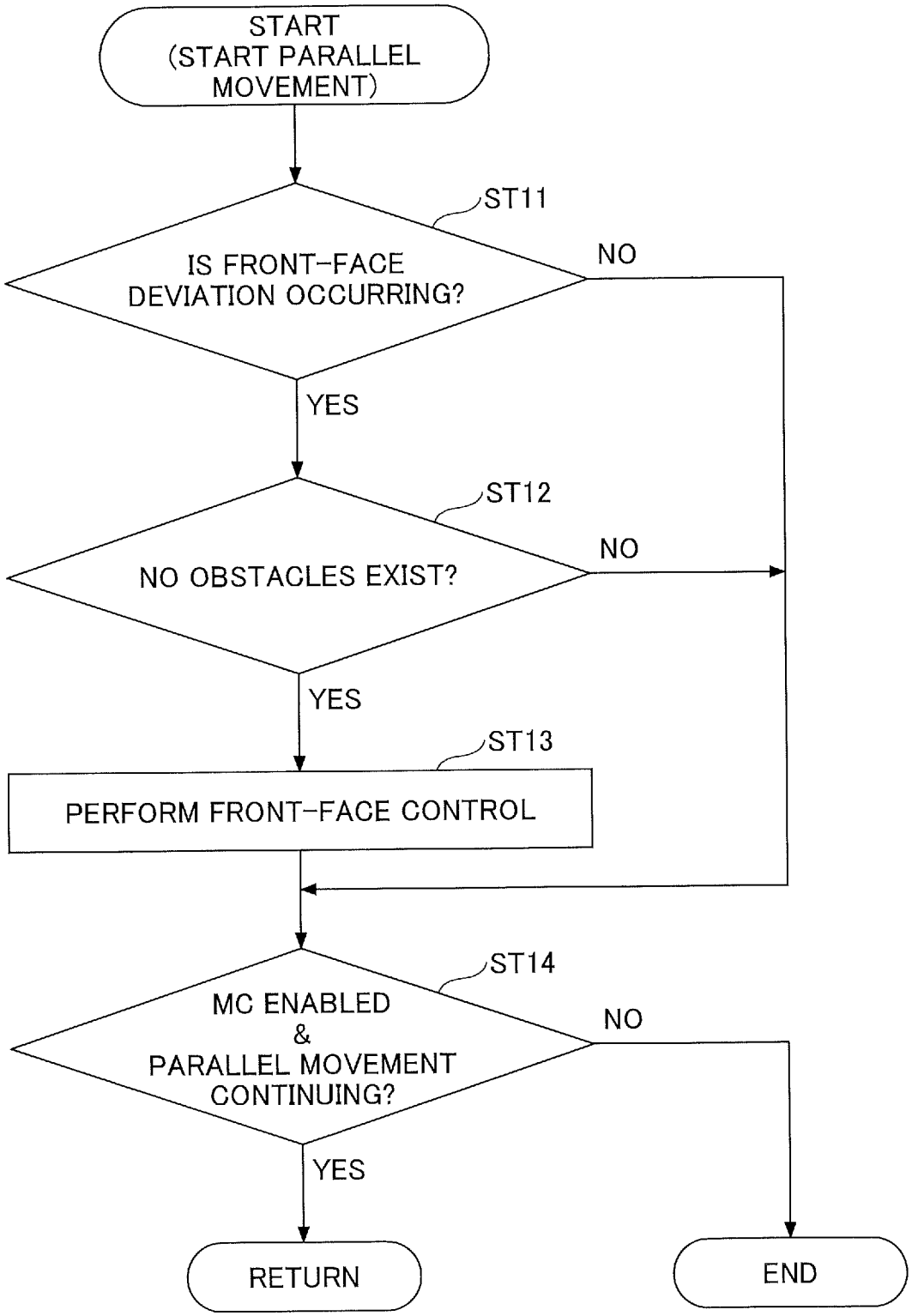
FIG. 10 is a flowchart schematically illustrating another example of a front-facing process by the controller of the excavator.

FIG. 10 is a flowchart schematically illustrating another example of the front-facing process by the controller 30 of the excavator 100 according to the present embodiment. The front-facing process according to the present flowchart is started, for example, when the machine control function is enabled and a parallel movement step of the excavator 100 is started. At this time, the controller 30 (the machine guidance unit 50) may determine that the excavator 100 (the lower traveling body 1) starts to move to the next work location along the target work surface based on the operation state with respect to the operation apparatus 26, the captured image of the imaging device S6, or the like.

Steps ST11 to ST13 are the same as the processes of steps ST1 to ST3 of FIG. 7, and thus the descriptions thereof will be omitted.

After the process of step ST13, or when the condition of step ST11 or step ST12 is not satisfied (in the case of NO in step ST11 or NO in step ST12), in step ST14, the machine guidance unit 50 determines whether the machine control function is enabled and the parallel movement is continuing. When this condition is satisfied, the machine guidance unit 50 returns to step ST11 and repeats the process according to this flowchart. When this condition is not satisfied, the process according to this flowchart is terminated.

As described above, unlike the case illustrated in FIG. 7, the controller 30 may specifically determine whether parallel movement of the excavator 100 along the target work surface is started, and upon making this determination, the controller 30 may maintain the front-facing state of the upper turning body 3 with respect to the target work surface during the parallel movement step. That is, the controller 30 performs front-face control so that the upper turning body 3 maintains the front-facing state with respect to the target work surface when the lower traveling body 1 performs an operation corresponding to the parallel movement step. Accordingly, the excavator 100 can constantly maintain the front-facing state of the upper turning body 3 with respect to the target work surface, while repeating a step in which parallel movement is performed after completion of work at a certain location and then starting work again, as in the case where the front-facing process illustrated in FIG. 7 is applied. Further, the excavator 100 maintains the front-facing state of the upper turning body 3 with respect to the target work surface without requiring an operation by an operator or the like during the parallel movement step of the excavator 100, thereby reducing burden felt by an operator or the like.

<Yet Another Example of Front-Facing Process>

Figure 11:
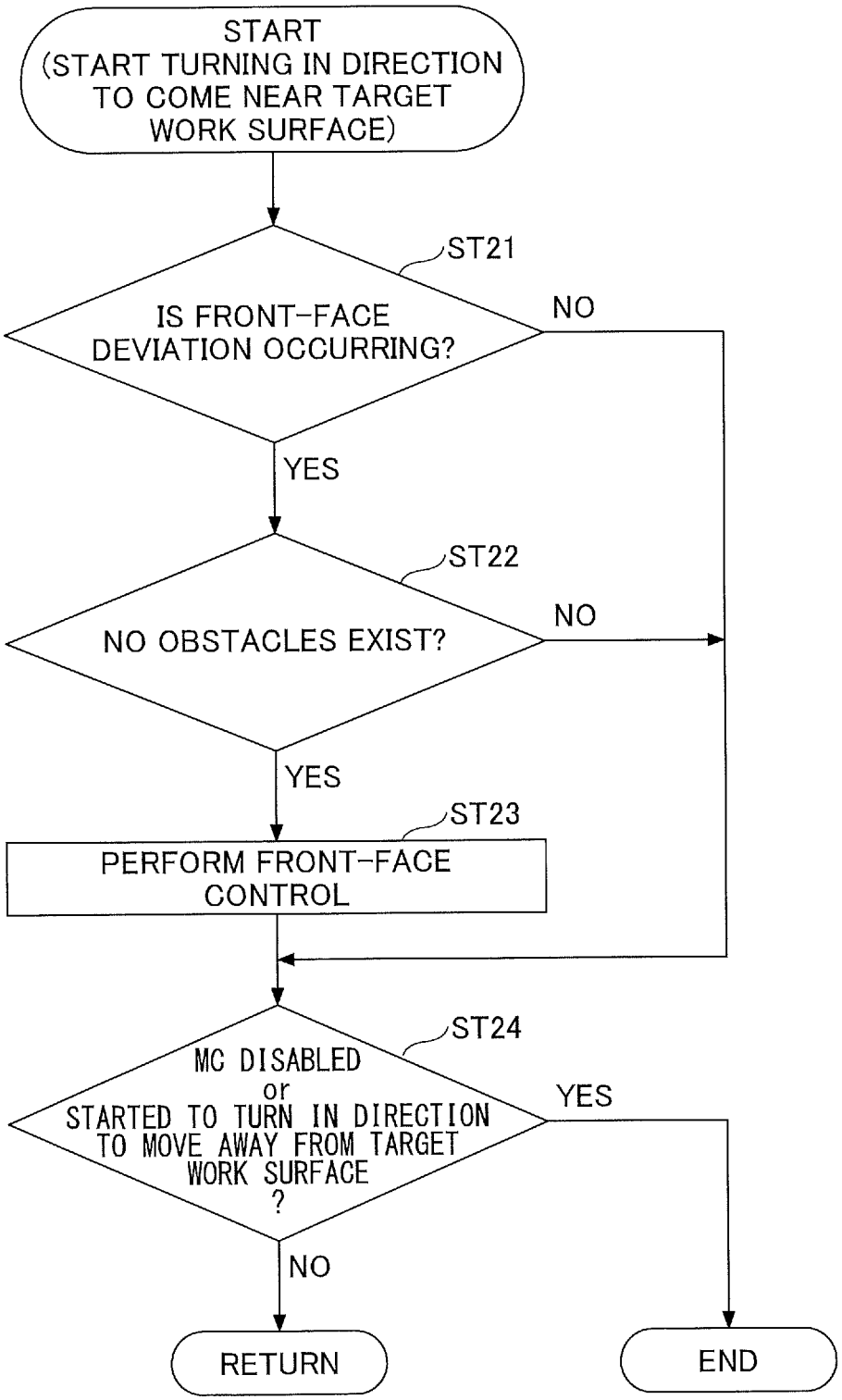
FIG. 11 is a flowchart schematically illustrating yet another example of a front-facing process by the controller of the excavator.

FIG. 11 is a flowchart schematically illustrating yet another example of a front-facing process by the controller 30 of the excavator 100 according to the present embodiment. The process using the present flowchart is started, for example, when the machine control function is enabled and a turning operation in the direction where the upper turning body 3 comes near the target work surface is started.

Steps ST21 through ST23 are the same as steps ST1 through ST3 in FIG. 7, and thus the description thereof will be omitted.

After the process of step ST23, or when the condition of step ST21 or ST22 is not satisfied (in the case of NO in step ST21 or NO in step S22), in step ST24, the machine guidance unit 50 determines whether the machine control function is disabled or whether the upper turning body 3 starts to turn in the direction away from the target work surface. In step ST24, when this condition is not satisfied (that is, when the machine control function is enabled and the upper turning body 3 does not start the turning operation in the direction away from the target work surface), the machine guidance unit 50 returns to step ST21 and repeats the process according to this flowchart. On the other hand, when this condition is satisfied (that is, when the machine control function is disabled or when the turning operation in the direction where the upper turning body 3 moves away from the target work surface is started), the machine guidance unit 50 terminates the process according to the present flowchart.

Thus, unlike FIG. 7, the controller 30 specifically determines whether a turning motion (turning operation) in the direction in which the upper turning body 3 of the excavator 100 comes near or moves away from the target work surface, has started. Based on the determination result, when the upper turning body 3 is turned in the direction in which the attachment comes near the target work surface (that is, when the turning operation starts in the direction in which the attachment comes near the target work surface), the controller 30 starts the front-face control. The controller 30 may continue the front-face control to maintain the front-facing state of the upper turning body 3 with respect to the target work surface, after the subsequent work step by the attachment and until the upper turning body 3 is turned in the direction where the attachment moves away from the target work surface (that is, until the upper turning body 3 starts to turn in the direction where the attachment moves away from the target work surface). Accordingly, the excavator 100 can maintain the front-facing state of the upper turning body 3 when the attachment is in operation at the time of work on the target work surface, as in the case where the front-facing process of FIG. 7 is applied. Therefore, the excavator 100 can more appropriately perform work on the target work surface. Further, the excavator 100 can maintain the front-facing state of the upper turning body 3 with respect to the target work surface, without requiring to be operated by an operator or the like, thereby reducing burden felt by the operator or the like. Therefore, similar to the case where the front-facing process of FIG. 7 is applied, in the soil discharging step, even when the upper turning body 3 turns in the direction to move away from the target work surface and the upper turning body 3 falls out of the front-facing state with respect to the target work surface, the excavator 100 can cause the upper turning body 3 to return to the front-facing state with respect to the target work surface again. Further, during a turning operation in a direction where the upper turning body 3 comes near the target work surface, the excavator 100 supports the operation by an operator or the like to cause the upper turning body 3 to front-face the target work surface, and therefore, burden felt by the operator or the like can be reduced.

[Configuration of Autonomous Operation Function of Excavator]

Figure 12A:
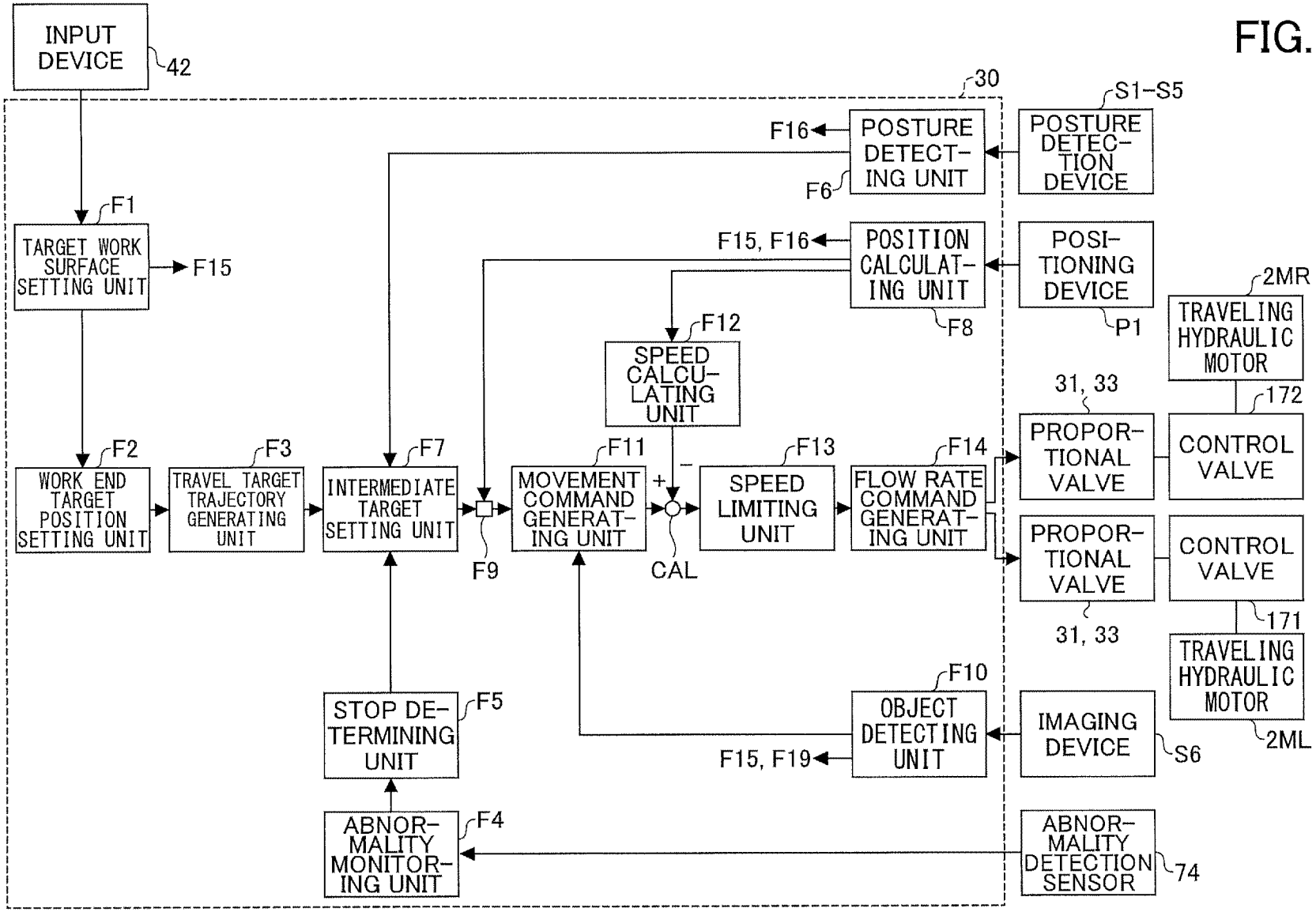
FIG. 12A is a diagram illustrating an example of a configuration related to an autonomous operation function of the excavator.
Figure 12B:
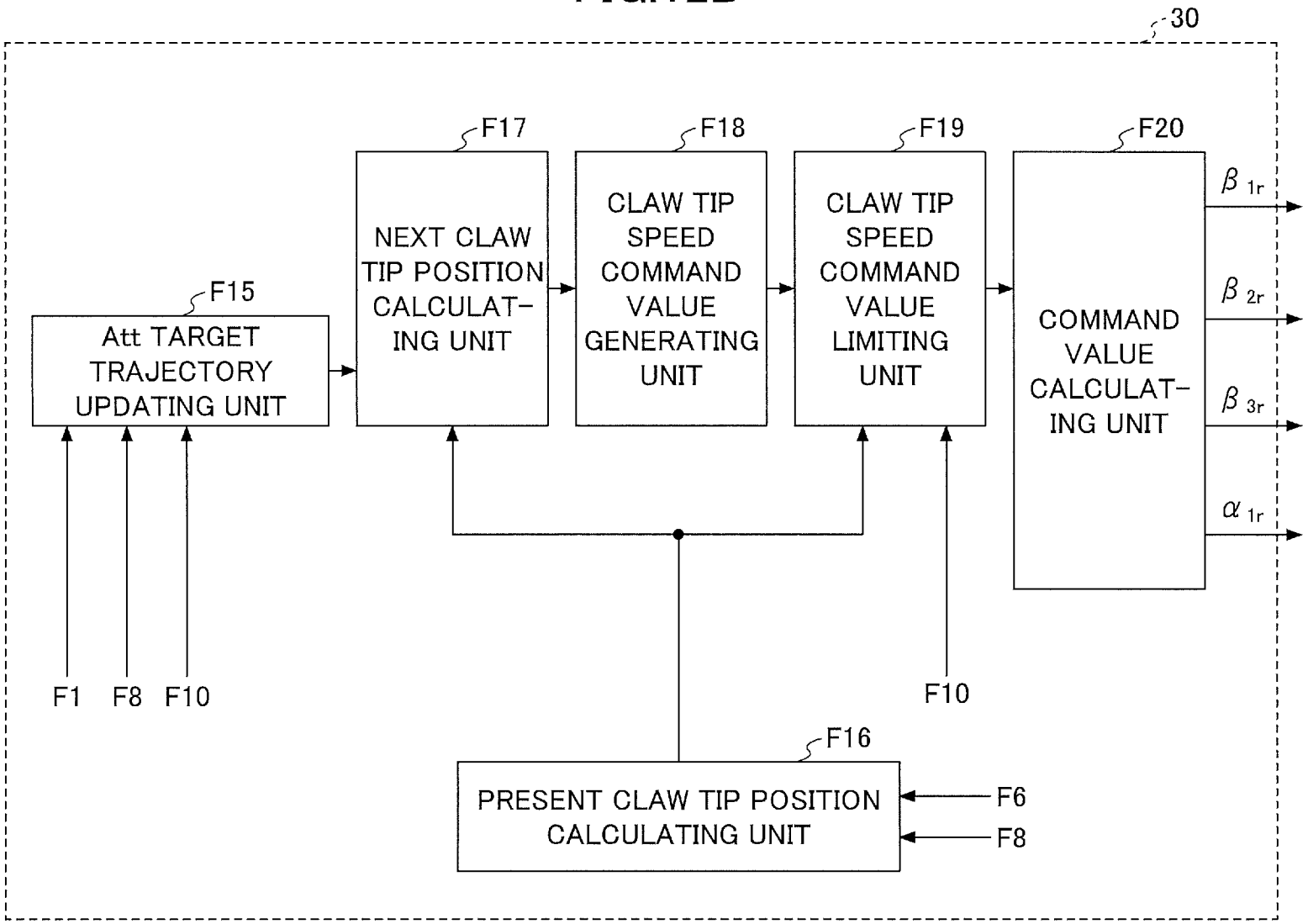
FIG. 12B is a diagram illustrating an example of a configuration related to an autonomous operation function of the excavator.
Figure 12C:
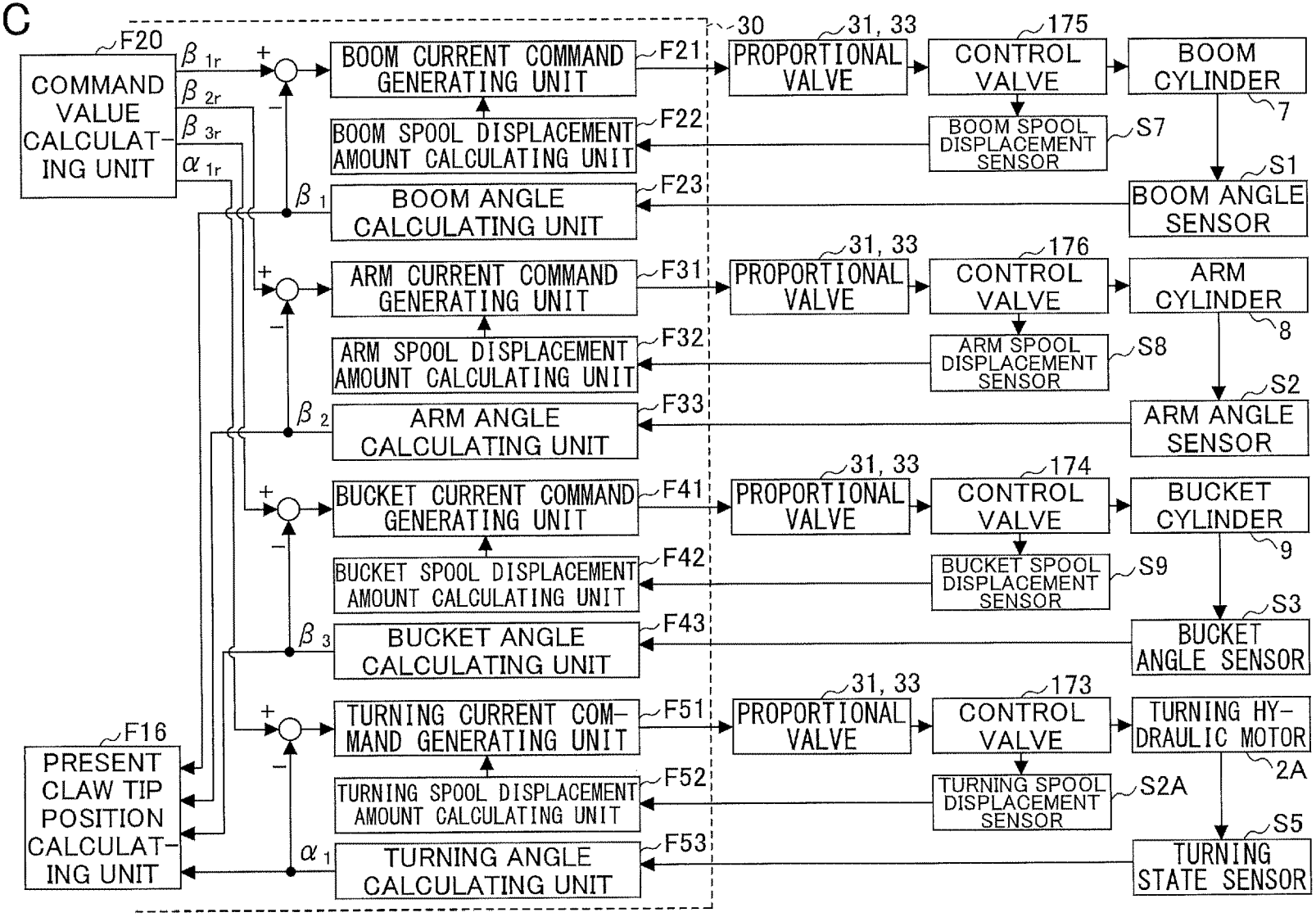
FIG. 12C is a diagram illustrating an example of a configuration related to an autonomous operation function of the excavator.

Next, a configuration regarding the autonomous operation function of the excavator 100 will be described with reference to FIG. 12 (FIGS. 12A to 12C).

FIGS. 12A to 12C are diagrams illustrating an example of a configuration regarding the autonomous operation function of the excavator 100. Specifically, FIG. 12A is a diagram illustrating an example of components related to the autonomous operation function of the lower traveling body 1. FIGS. 12B and 12C are diagrams illustrating examples of components related to the autonomous operation function of the upper turning body 3 and the attachment AT.

In this example, the controller 30 is configured to receive signals output by at least one of a posture detection device, the input device 42, the imaging device S6, the positioning device P1, and an abnormality detection sensor 74, perform various computations, and output a control command to the proportional valve 31 and the proportional valve 33, or the like. The posture detection device includes the boom angle sensor S1, the arm angle sensor S2, the bucket angle sensor S3, the machine tilt sensor S4, and the turning state sensor S5.

The controller 30 includes a target work surface setting unit F1, a work end target position setting unit F2, a travel target trajectory generating unit F3, an abnormality monitoring unit F4, a stop determining unit F5, a posture detecting unit F6, an intermediate target setting unit F7, a position calculating unit F8, a comparing unit F9, an object detecting unit F10, a movement command generating unit F11, a speed calculating unit F12, a speed limiting unit F13, and a flow rate command generating unit F14. The controller 30 includes an Att target trajectory updating unit F15, a present claw tip position calculating unit F16, a next claw tip position calculating unit F17, a claw tip speed command value generating unit F18, a claw tip speed command value limiting unit F19, a command value calculating unit F20, a boom current command generating unit F21, a boom spool displacement amount calculating unit F22, a boom angle calculating unit F23, an arm current command generating unit F31, an arm spool displacement amount calculating unit F32, an arm angle calculating unit F33, a bucket current command generating unit F41, a bucket spool displacement amount calculating unit F42, a bucket angle calculating unit F43, a turning current command generating unit F51, a turning spool displacement amount calculating unit F52, and a turning angle calculating unit F53.

The target work surface setting unit F1 sets the target work surface in accordance with the output of the input device 42, that is, the operation input received by the input device 42. The target work surface setting unit F1 may set the target work surface based on information received from an external apparatus (for example, the management apparatus 300 described below) through the communication device T1.

The work end target position setting unit F2 is configured to set a target position (hereinafter, "work end target position") for autonomous traveling of the excavator 100 (the lower traveling body 1) corresponding to a predetermined work end position. For example, as illustrated in FIG. 8B, the work end target position setting unit F2 may set the work end target position corresponding to the work end position of the slope to be worked on while the excavator 100 is caused to travel autonomously in parallel to the target work surface. The work end position may be included in the information about the target work surface taken from the input device 42, or may be automatically generated based on the target work surface.

The travel target trajectory generating unit F3 generates a travel target trajectory (for example, the travel target trajectory TT in FIG. 8B) for autonomous traveling of the excavator 100 (the lower traveling body 1) based on the shape of the target work surface and the work end target position. The travel target trajectory generating unit F3 may set an error tolerance range (for example, the error tolerance range TR of FIG. 8B) for the travel target trajectory to be generated.

The abnormality monitoring unit F4 is configured to monitor the abnormality of the excavator 100. In this example, the abnormality monitoring unit F4 determines the degree of abnormality of the excavator 100 based on the output of the abnormality detection sensor 74. The abnormality detection sensor 74 may include at least one of, for example, a sensor for detecting an abnormality in the engine 11, a sensor for detecting an abnormality in relation to the temperature of the hydraulic oil, and a sensor for detecting an abnormality in the controller 30.

The stop determining unit F5 is configured to determine whether it is necessary to stop the excavator 100 based on various kinds of information. In the present example, the stop determining unit F5 determines whether it is necessary to stop the excavator 100 during autonomous traveling based on the output of the abnormality monitoring unit F4. Specifically, the stop determining unit F5 determines that it is necessary to stop the excavator 100 during autonomous traveling when the degree of abnormality of the excavator 100 determined by the abnormality monitoring unit F4 exceeds a predetermined threshold value. In this case, for example, the controller 30 controls the braking of the traveling hydraulic motor 2M as a traveling actuator to slow down or stop the rotation of the traveling hydraulic motor 2M. On the other hand, for example, when the degree of abnormality of the excavator 100 determined by the abnormality monitoring unit F4 is less than or equal to a predetermined threshold value, the stop determining unit F5 determines that it is not necessary to stop the excavator 100 during autonomous traveling, that is, the autonomous traveling of the excavator 100 can be continued. Further, when a person (an operator) is riding the excavator 100, the stop determining unit F5 may determine whether autonomous traveling is to be canceled in addition to whether it is necessary to stop the excavator 100.

The posture detecting unit F6 is configured to detect information about the posture of the excavator 100. Further, the posture detecting unit F6 may determine whether the posture of the excavator 100 is a traveling posture. The posture detecting unit F6 may be configured to allow execution of autonomous traveling of the excavator 100 when it is determined that the posture of the excavator 100 is a traveling posture.

The intermediate target setting unit F7 is configured to set the intermediate target position with respect to the autonomous traveling of the excavator 100 (for example, the intermediate target positions TP1 to TP4 of FIG. 8B). In the present example, when it is determined by the posture detecting unit F6 that the posture of the excavator 100 is a traveling posture and it is determined by the stop determining unit F5 that it is not necessary to stop the excavator 100, the intermediate target setting unit F7 may set one or more intermediate target positions on the travel target trajectory.

The position calculating unit F8 is configured to calculate the present position of the excavator 100. In the present example, the position calculating unit F8 calculates the present position of the excavator 100 based on the output of the positioning device P1. When the excavator is performing slope work, the work end target position setting unit F2 may set the end position of the slope work as the final target position. The intermediate target setting unit F7 may divide the slope work from the start position to the end position into a plurality of sections and set the end point of each section as the intermediate target position.

The comparing unit F9 is configured to compare the intermediate target position set by the intermediate target setting unit F7 with the present position of the excavator 100 calculated by the position calculating unit F8.

The object detecting unit F10 is configured to detect an object present around the excavator 100. In this example, the object detecting unit F10 detects an object present around the excavator 100 based on the output of the imaging device S6. The object detecting unit F10 generates a stop command for stopping autonomous traveling of the excavator 100 when an object (for example, a person) present in the traveling direction of the excavator 100 during autonomous traveling is detected.

The movement command generating unit F11 is configured to generate a command regarding the traveling movement of the lower traveling body 1. In this example, the movement command generating unit F11 generates, based on the comparison result of the comparing unit F9, a command regarding the movement direction and a command regarding the movement speed (hereinafter, "speed command"). For example, the movement command generating unit F11 may be configured to generate a higher speed command as the difference between the intermediate target position and the present position of the excavator 100 becomes larger. The movement command generating unit F11 may be configured to generate a speed command that makes the difference close to zero.

In this manner, for example, the controller 30 performs the travel control by causing the excavator 100 to repeat the acts of autonomously traveling to an intermediate target position, performing predetermined work at the intermediate target position, and subsequently moving to the next intermediate position, until travel to the target position is completed. Further, when it is determined that the excavator 100 is present on a tilted ground based on the previously input landform information and the detected value of the positioning device P1, the movement command generating unit F11 may change the value of the speed command. For example, when it is determined that the excavator 100 is on a downhill slope, the movement command generating unit F11 may generate a speed command value corresponding to a speed that is slower than a normal speed. The movement command generating unit F11 may acquire information about a landscape, such as the tilt of the ground, based on the output of the imaging device S6. Further, based on the output of the imaging device S6, when it is determined by the object detecting unit F10 that the surface of the road has large irregularities (for example, when it is determined that a large number of stones exist on the surface of the road), the movement command generating unit F11 may generate a speed command value corresponding to a speed that is slower than the normal speed. As described above, the movement command generating unit F11 may change the value of the speed command based on the acquired information on the acquired road surface on the traveling route. For example, when the excavator 100 moves from a sand area to a gravel road at a riverbed, the movement command generating unit F11 may automatically change the value of the speed command. Accordingly, the movement command generating unit F11 can change the traveling speed according to the road surface condition. Further, the movement command generating unit F11 may generate a speed command value corresponding to the operation of the attachment. For example, when the excavator 100 is performing slope work (specifically, when the attachment is performing finishing work from the top of slope to the toe of slope), the intermediate target setting unit F7 may determine to start moving to the next intermediate target position, when it is determined that the bucket 6 has reached the toe of slope. Therefore, the movement command generating unit F11 can generate the speed command to the next intermediate target position. When it is determined that the boom 4 has risen to a predetermined height after the bucket 6 has reached the toe of slope, the intermediate target setting unit F7 may determine the start of movement to the next intermediate target position. The movement command generating unit F11 may generate a speed command to the next intermediate target position. In this manner, the movement command generating unit F11 may set the speed command value according to the operation of the attachment.

The controller 30 may further include a mode setting unit for setting the operation mode of the excavator 100. In this case, when a crane mode is set as the operation mode of the excavator 100, or when a slow mode, such as a slow speed high torque mode, is set, the movement command generating unit F11 generates a speed command value corresponding to the slow mode. As described above, the movement command generating unit F11 may change the speed command value (the traveling speed) in accordance with the state of the excavator 100.

The speed calculating unit F12 is configured to calculate the present traveling speed of the excavator 100. In the present example, the speed calculating unit F12 calculates the present traveling speed of the excavator 100 based on the transition of the present position of the excavator 100 calculated by the position calculating unit F8.

A calculating unit CAL is configured to calculate the speed difference between the traveling speed corresponding to the speed command generated by the movement command generating unit F11 and the present traveling speed of the excavator 100 calculated by the speed calculating unit F12.

The speed limiting unit F13 is configured to limit the traveling speed of the excavator 100. In the present example, when the speed difference calculated by the calculating unit CAL exceeds the limit value, the speed limiting unit F13 outputs the limit value instead of the speed difference, and when the speed difference calculated by the calculating unit CAL is less than or equal to the limit value, the speed limiting unit F13 is configured to directly output the speed difference. The limit value may be a pre-registered value or a dynamically calculated value.

The flow rate command generating unit F14 is configured to generate a command regarding the flow rate of the hydraulic oil supplied from the main pump 14 to the traveling hydraulic motor 2M. In this example, the flow rate command generating unit F14 generates the flow rate command based on the speed difference output by the speed limiting unit F13. Basically, the flow rate command generating unit F14 may be configured to generate a higher flow rate command as the speed difference becomes larger. The flow rate command generating unit F14 may be configured to generate the flow rate command for bringing the speed difference calculated by the calculating unit CAL close to zero.

The flow rate command generated by the flow rate command generating unit F14 is a current command for the proportional valves 31 and 33. The proportional valves 31 and 33 operate according to the corresponding current commands to vary the pilot pressure acting on the pilot port of the control valve 171. Therefore, the flow rate of the hydraulic oil flowing into the traveling hydraulic motor 2ML is adjusted to be the flow rate corresponding to the flow rate command generated by the flow rate command generating unit F14. Further, the proportional valves 31 and 33 operate according to the corresponding current commands to vary the pilot pressure acting on the pilot port of the control valve 172. Therefore, the flow rate of the hydraulic oil flowing into the traveling hydraulic motor 2MR is adjusted to be the flow rate corresponding to the flow rate command generated by the flow rate command generating unit F14. As a result, the traveling speed of the excavator 100 is adjusted to be the traveling speed corresponding to the speed command generated by the movement command generating unit F11. The traveling speed of the excavator 100 is a concept that includes the traveling direction. This is because the traveling direction of the excavator 100 is determined based on the revolution speed and rotation direction of the traveling hydraulic motor 2ML and the revolution speed and rotation direction of the traveling hydraulic motor 2MR.

In this example, it is indicated that the flow rate command generated by the flow rate command generating unit F14 is output to the proportional valves 31 and 33, but the controller 30 is not limited to this configuration. For example, usually, during the traveling operation of the excavator 100, no other actuators other than the traveling hydraulic motor 2M, such as the boom cylinder 7, are operated. Therefore, the flow rate command generated by the flow rate command generating unit F14 may be output to the regulator 13 of the main pump 14. In this case, the controller 30 can control the traveling operation of the excavator 100 by controlling the discharge amount of the main pump 14. The controller 30 may control the steering of the excavator 100 by controlling each of the regulators 13L and 13R, that is, by controlling the discharge amount of each of the main pumps 14L and 14R. Further, the controller 30 may control the steering of the traveling operation by controlling the amount of hydraulic oil supplied to each of the traveling hydraulic motors 2ML and 2MR by the proportional valve 31, and control the driving speed by controlling the regulator 13.

As described above, the controller 30 can implement autonomous traveling of the excavator 100 from the present position to the work end target position while the excavator 100 appropriately performs work at the intermediate target positions.

The Att target trajectory updating unit F15 is configured to generate a target trajectory of the leading end of the attachment, i.e., the working portion (e.g., the claw tip) of the bucket 6. Specifically, the Att target trajectory updating unit F15 may update the travel target trajectory of the working portion of the bucket 6 for each movement associated with autonomous travel of the excavator 100 in accordance with a position (the intermediate target position) of the excavator 100 after movement and the relative shape and the like of the target work surface viewed from that position. For example, the Att target trajectory updating unit F15 may generate a trajectory to be followed by the claw tip of the bucket 6 as the target trajectory based on the shape of the target work surface, the present position of the excavator 100, and the output (object data) and the like of the object detecting unit F10.

The present claw tip position calculating unit F16 is configured to calculate the present claw tip position of the bucket 6. In this example, the present claw tip position calculating unit F16 may calculate the coordinate point of the claw tip of the bucket 6 as the present claw tip position based on the output of the posture detecting unit F6 (for example, the boom angle $\beta_1$, the arm angle $\beta_2$, the bucket angle $\beta_3$, and the turning angle $\alpha_1$) and the output of the position calculating unit F8 (the present position of the excavator 100). When calculating the present claw tip position, the present claw tip position calculating unit F16 may use the output of the machine tilt sensor S4.

The next claw tip position calculating unit F17 is configured to calculate the target next claw tip position on the target trajectory of the claw tip of the bucket 6. In the present example, the next claw tip position calculating unit F17 calculates the claw tip position after a predetermined time as the target claw tip position based on the contents of the operation command corresponding to the autonomous operation function, the target trajectory generated by the Att target trajectory updating unit F15, and the present claw tip position calculated by the present claw tip position calculating unit F16.

The next claw tip position calculating unit F17 may determine whether the deviation between the present claw tip position and the target trajectory of the claw tip of the bucket 6 is within an acceptable range. In the present example, the next claw tip position calculating unit F17 determines whether the distance between the present claw tip position and the target trajectory of the claw tip of the bucket 6 is less than or equal to a predetermined value. When the distance is less than or equal to a predetermined value, the next claw tip position calculating unit F17 determines that the deviation is within an allowable range and calculates the target claw tip position. On the other hand, when the distance exceeds the predetermined value, the next claw tip position calculating unit F17 determines that the deviation does not fall within the allowable range and reduces or stops the movement of the actuator irrespective of the operation command corresponding to the autonomous operation function. Thus, the controller 30 can prevent the execution of autonomous control from continuing while the claw tip position is out of the target trajectory.

The claw tip speed command value generating unit F18 is configured to generate a command value related to the claw tip speed. In the present example, based on the present claw tip position calculated by the present claw tip position calculating unit F16 and the next claw tip position calculated by the next claw tip position calculating unit F17, the claw tip speed command value generating unit F18 calculates, as a command value relating to the claw tip speed, the claw tip speed required to move the present claw tip position to the next claw tip position at a predetermined time.

The claw tip speed command value limiting unit F19 is configured to limit the command value related to the claw tip speed. In the present example, when it is determined that the distance between the claw tip of the bucket 6 and a predetermined object (for example, a dump truck) is less than a predetermined value based on the present claw tip position calculated by the present claw tip position calculating unit F16 and the output of the object detecting unit F10, the claw tip speed command value limiting unit F19 limits the command value related to the claw tip speed by the predetermined upper limit value. This allows the controller 30 to slow down the claw tip speed when the claw tip approaches a dump truck or the like.

The command value calculating unit F20 is configured to calculate a command value for operating the actuator. In this example, in order to move the present claw tip position to the target claw tip position, the command value calculating unit F20 calculates the command value $\beta_{1r}$ for the boom angle $\beta_1$, the command value $\beta_{2r}$ for the arm angle $\beta_2$, the command value $\beta_{3r}$ for the bucket angle $\beta_3$, and the command value $\alpha_{1r}$ for the turning angle $\alpha_i$ based on the target claw tip position calculated by the next claw tip position calculating unit F17.

The boom current command generating unit F21, the arm current command generating unit F31, the bucket current command generating unit F41, and the turning current command generating unit F51 are configured to generate a current command to be output to the proportional valves 31 and 33. In this example, the boom current command generating unit F21 outputs a boom current command to the proportional valve 31 corresponding to the control valve 175. The arm current command generating unit F31 outputs an arm current command to the proportional valve 31 corresponding to the control valve 176. The bucket current command generating unit F41 outputs the bucket current command to the proportional valve 31 corresponding to the control valve 174. The turning current command generating unit F51 outputs a turning current command to the proportional valve 31 corresponding to the control valve 173. The boom current command generating unit F21, the arm current command generating unit F31, the bucket current command generating unit F41, and the turning current command generating unit F51 may output, to the proportional valve 33, a decompression command for depressurizing the pilot pressure output from the operation apparatus 26.

The boom spool displacement amount calculating unit F22, the arm spool displacement amount calculating unit F32, the bucket spool displacement amount calculating unit F42, and the turning spool displacement amount calculating unit F52 are configured to calculate the displacement amount of the spool constituting the spool valve. In the present example, the boom spool displacement amount calculating unit F22 calculates a displacement amount of the boom spool constituting the control valve 175 with respect to the boom cylinder 7 based on the output of the boom spool displacement sensor S7. The arm spool displacement amount calculating unit F32 calculates the displacement amount of the arm spool constituting the control valve 176 with respect to the arm cylinder 8 based on the output of the arm spool displacement sensor S8. The bucket spool displacement amount calculating unit F42 calculates the displacement amount of the bucket spool constituting the control valve 174 with respect to the bucket cylinder 9 based on the output of the bucket spool displacement sensor S9. The turning spool displacement amount calculating unit F52 calculates the displacement amount of the turning spool constituting the control valve 173 with respect to the turning hydraulic motor 2A based on the output of the turning spool displacement sensor S2A.

The boom angle calculating unit F23, the arm angle calculating unit F33, the bucket angle calculating unit F43, and the turning angle calculating unit F53 are configured to calculate the rotation angle (posture angle) of the boom 4, the arm 5, the bucket 6, and the upper turning body 3, respectively. In the present example, the boom angle calculating unit F23 calculates the boom angle $\beta_1$ based on the output of the boom angle sensor S1. The arm angle calculating unit F33 calculates the arm angle $\beta_2$ based on the output of the arm angle sensor S2. The bucket angle calculating unit F43 calculates the bucket angle $\beta_3$ based on the output of the bucket angle sensor S3. The turning angle calculating unit F53 calculates the turning angle $\alpha_1$ based on the output of the turning state sensor S5. That is, the boom angle calculating unit F23, the arm angle calculating unit F33, the bucket angle calculating unit F43, and the turning angle calculating unit F53 are included in the posture detecting unit F6, and the calculation result (the boom angle $\beta_1$, the arm angle $\beta_2$, the bucket angle $\beta_3$, and the turning angle $\alpha_1$) may be output to the present claw tip position calculating unit F16.

The boom current command generating unit F21 basically generates a boom current command to the proportional valve 31 so that the difference between the command value $\beta_{1r}$ generated by the command value calculating unit F20 and the boom angle $\beta_1$ calculated by the boom angle calculating unit F23 becomes zero. At that time, the boom current command generating unit F21 adjusts the boom current command so that the difference between the target boom spool displacement amount derived from the boom current command and the boom spool displacement amount calculated by the boom spool displacement amount calculating unit F22 becomes zero. The boom current command generating unit F21 outputs the boom current command after adjustment to the proportional valve 31 corresponding to the control valve 175.

The proportional valve 31 (the proportional valves 31AL, 31AR of FIG. 6A) corresponding to the control valve 175 varies the opening area thereof in response to a boom current command and causes pilot pressure corresponding to the size of the opening area thereof to act on the pilot port of the control valve 175. The control valve 175 moves the boom spool in response to pilot pressure to allow hydraulic oil to flow into the boom cylinder 7. The boom spool displacement sensor S7 detects a displacement of the boom spool and feeds back the detection result to the boom spool displacement amount calculating unit F22 of the controller 30. The boom cylinder 7 is extended or contracted in response to an inflow of hydraulic oil, and moves the boom 4 up or down. The boom angle sensor S1 detects the rotation angle of the vertically moving boom 4 and feeds back the detection result to the boom angle calculating unit F23 of the controller 30. The boom angle calculating unit F23 feeds back the calculated boom angle β1 to the boom current command generating unit F21.

The arm current command generating unit F31 basically generates an arm current command to the proportional valve 31 so that the difference between the command value $\beta_{2r}$ generated by the command value calculating unit F20 and the arm angle $\beta_2$ calculated by the arm angle calculating unit F33 becomes zero. At this time, the arm current command generating unit F31 adjusts the arm current command so that the difference between the target arm spool displacement amount derived from the arm current command and the arm spool displacement amount calculated by the arm spool displacement amount calculating unit F32 becomes zero. The arm current command generating unit F31 outputs the adjusted arm current command to the proportional valve 31 corresponding to the control valve 176.

The proportional valve 31 corresponding to the control valve 176 varies the opening area thereof in response to an arm current command to apply a pilot pressure corresponding to the size of the opening area to the pilot port of the control valve 176. The control valve 176 moves the arm spool in response to pilot pressure to allow hydraulic oil to flow into the arm cylinder 8. The arm spool displacement sensor S8 detects the displacement of the arm spool and feeds back the detection result to the arm spool displacement amount calculating unit F32 of the controller 30. The arm cylinder 8 expands and contracts in response to the inflow of hydraulic oil to open and close the arm 5. The arm angle sensor S2 detects the rotation angle of the opening/closing arm 5 and feeds back the detection result to the arm angle calculating unit F33 of the controller 30. The arm angle calculating unit F33 feeds back the calculated arm angle $\beta_2$ to the arm current command generating unit F31.

The bucket current command generating unit F41 basically generates a bucket current command to the proportional valve 31 corresponding to the control valve 174 so that the difference between the command value $\beta_{3r}$ generated by the command value calculating unit F20 and the bucket angle $\beta_3$ calculated by the bucket angle calculating unit F43 becomes zero. At that time, the bucket current command generating unit F41 adjusts the bucket current command so that the difference between the target bucket spool displacement amount derived from the bucket current command and the bucket spool displacement amount calculated by the bucket spool displacement amount calculating unit F42 becomes zero. The bucket current command generating unit F41 outputs the bucket current command after adjustment to the proportional valve 31 corresponding to the control valve 174.

The proportional valve 31 (the proportional valves 31BL, 31BR of FIG. 6B) corresponding to the control valve 174 varies the opening area thereof in response to a bucket current command to apply pilot pressure corresponding to the size of the opening area to the pilot port of the control valve 174. The control valve 174 moves the bucket spool in response to pilot pressure to allow hydraulic oil to flow into the bucket cylinder 9. The bucket spool displacement sensor S9 detects the displacement of the bucket spool and feeds back the detection result to the bucket spool displacement amount calculating unit F42 of the controller 30. The bucket cylinder 9 extends and contracts in response to the inflow of hydraulic oil to open and close the bucket 6. The bucket angle sensor S3 detects the rotation angle of the opening/closing bucket 6 and feeds back the detection result to the bucket angle calculating unit F43 of the controller 30. The bucket angle calculating unit F43 feeds back the calculated bucket angle $\beta_3$ to the bucket current command generating unit F41.

The turning current command generating unit F51 basically generates a turning current command for the proportional valve 31 corresponding to the control valve 173 so that the difference between the command value $\alpha_{1r}$ generated by the command value calculating unit F20 and the turning angle α1 calculated by the turning angle calculating unit F53 becomes zero. At this time, the turning current command generating unit F51 adjusts the turning current command so that the difference between the target turning spool displacement amount derived from the turning current command and the turning spool displacement amount calculated by the turning spool displacement amount calculating unit F52 becomes zero. The turning current command generating unit F51 outputs the turning current command after adjustment to the proportional valve 31 corresponding to the control valve 173.

The proportional valve 31 (proportional valves 31CL, 31CR of FIG. 6C) corresponding to the control valve 173 varies the opening area thereof in response to a turning current command to apply pilot pressure corresponding to the size of the opening area to the pilot port of the control valve 173. The control valve 173 moves the turning spool in response to pilot pressure to allow hydraulic oil to flow into the turning hydraulic motor 2A. The turning spool displacement sensor S2A detects the displacement of the turning spool and feeds back the detection result to the turning spool displacement amount calculating unit F52 of the controller 30. The turning hydraulic motor 2A rotates in response to the inflow of hydraulic oil to turn the upper turning body 3. The turning state sensor S5 detects the turning angle of the upper turning body 3 and feeds back the detection result to the turning angle calculating unit F53 of the controller 30. The turning angle calculating unit F53 feeds back the calculated turning angle α1 to the turning current command generating unit F51.

As such, the controller 30 forms a three-stage feedback loop for each workpiece. That is, the controller 30 constitutes a feedback loop for the spool displacement amount, a feedback loop for the workpiece rotation angle, and a feedback loop for claw tip position. Accordingly, the controller 30 can implement the autonomous operation function of having the excavator 100 perform predetermined operations (for example, construction work of the slope as the target work surface) at each intermediate target position by highly precisely controlling the motion of the working portion (for example, the claw tip) of the bucket 6.

[Excavator Management System]

Next, an excavator management system SYS will be described with reference to FIG. 13.

Figure 13:
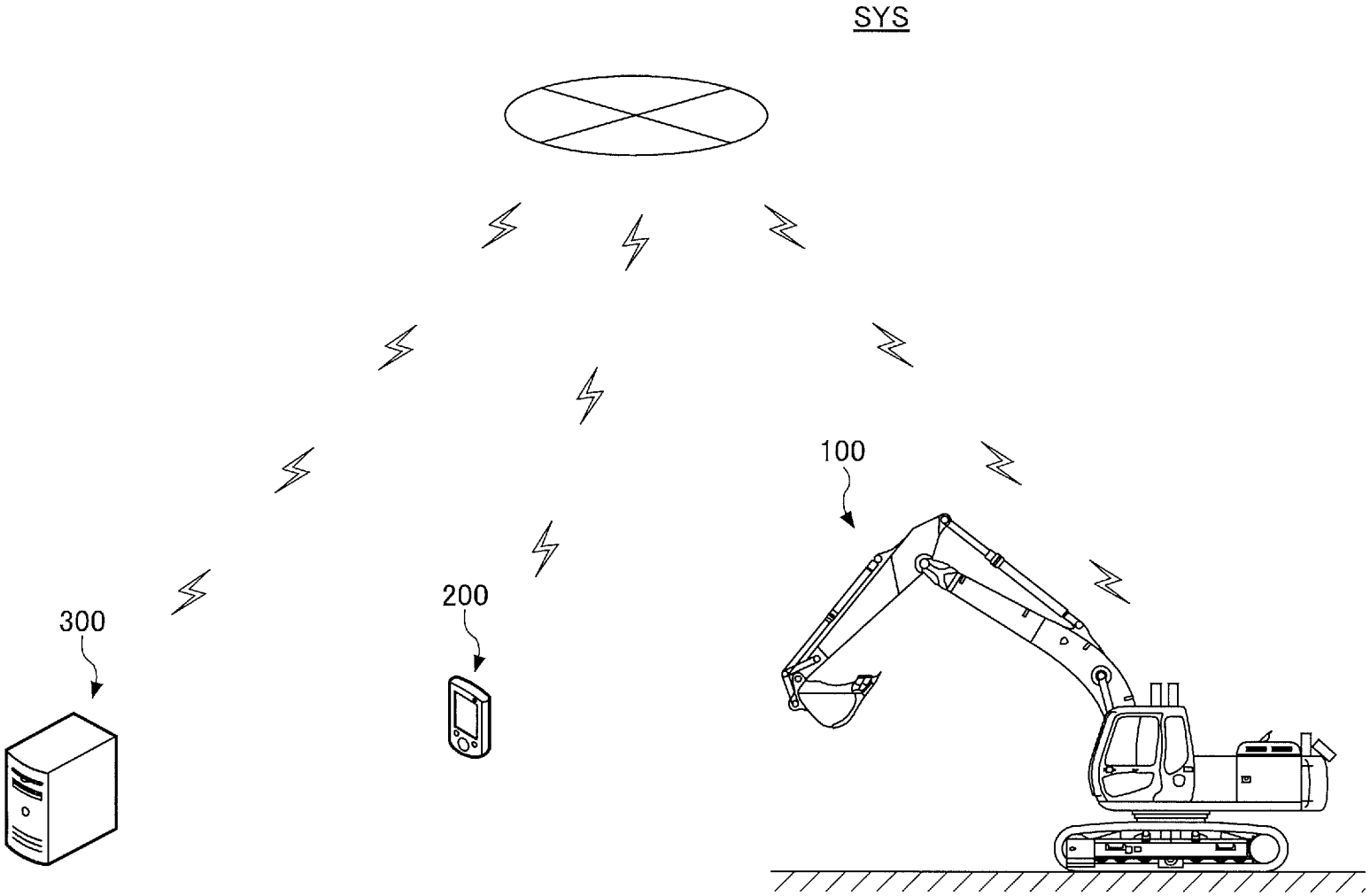
FIG. 13 is a schematic diagram illustrating an example of an excavator management system.

FIG. 13 is a schematic diagram illustrating an example of the excavator management system SYS.

As illustrated in FIG. 13, the excavator management system SYS includes the excavator 100, a support apparatus 200, and a management apparatus 300. The excavator management system SYS is a system that manages one or more excavators 100.

The information obtained by the excavator 100 may be shared with the administrator and operators of other excavators through the excavator management system SYS. Each of the excavator 100, the support apparatus 200, and the management apparatus 300 included in the excavator management system SYS may be a single unit or multiple units. In this example, the excavator management system SYS includes one excavator 100, one support apparatus 200, and one management apparatus 300.

The support apparatus 200 is typically a portable terminal apparatus, such as a laptop computer terminal, a tablet terminal, or a smartphone carried by a worker or the like at a construction site. The support apparatus 200 may be a portable terminal carried by an operator of the excavator 100. The support apparatus 200 may be a fixed terminal apparatus.

The management apparatus 300 is typically a fixed terminal apparatus, for example, a server computer (so-called cloud server) installed in a management center or the like outside a construction site. The management apparatus 300 may be, for example, an edge server configured at a construction site. The management apparatus 300 may also be a portable terminal apparatus (e.g., a portable terminal such as a laptop computer terminal, a tablet terminal, or a smartphone).

At least one of the support apparatus 200 and the management apparatus 300 may include a monitor and a remote operation device. In this case, an operator using the support apparatus 200 or the management apparatus 300 may operate the excavator 100 while using the remote operation device. The remote operation device is communicatively connected to the controller 30 mounted on the excavator 100, for example, via a wireless communication network, such as a short range wireless communication network, a cellular telephone communication network, or a satellite communication network.

Various information images displayed on the display device 40 disposed in the cabin 10 (for example, image information representing the surroundings of the excavator 100, various setting screens, or the like) may be displayed by a display device connected to at least one of the support apparatus 200 and the management apparatus 300. Image information representing the surroundings of the excavator 100 may be generated based on the captured image of the imaging device S6. Accordingly, a worker who uses the support apparatus 200 or a manager who uses the management apparatus 300 may remotely control the excavator 100 or make various settings regarding the excavator 100 while checking the surrounding condition of the excavator 100.

For example, in the excavator management system SYS, the controller 30 of the excavator 100 may transmit, to at least one of the support apparatus 200 and the management apparatus 300, information about at least one of the time and location when the autonomous traveling switch is pressed down, the target route used to move the excavator 100 autonomously (during autonomous traveling), and the trajectory actually traced by a predetermined portion during autonomous traveling. At this time, the controller 30 may transmit the output of a spatial recognition device, such as the imaging device S6 (for example, a captured image of the imaging device S6) to at least one of the support apparatus 200 and the management apparatus 300. The captured image may be a plurality of images captured during autonomous traveling. Further, the controller 30 may transmit, to at least one of the support apparatus 200 and the management apparatus 300, information about, for example, data regarding the operation of the excavator 100 during autonomous traveling, data regarding the posture of the excavator 100, and data regarding the posture of the drilling attachment, or any combination thereof. Thus, a worker using the support apparatus 200 or an administrator using the management apparatus 300 can obtain information about the excavator 100 during autonomous traveling.

In this manner, the excavator management system SYS enables information about the excavator 100 acquired during autonomous traveling, to be shared with an administrator and operators of other excavators.

[Modifications/Variations]

While the embodiments have been described in detail above, the present disclosure is not limited to such particular embodiments, and various modifications and variations are possible within the scope of the scope of the appended claims.

For example, in the embodiments described above, the controller 30 may perform front-face control when a predetermined switch included in the input device 42 is operated. Specifically, the controller 30 may, for example, perform front-face control when the MC switch is operated, or when the operation is continued, that is, when the MC switch is pressed down continuously. In this case, in order to start the machine control function, it is possible to automatically cause the upper turning body 3 to front-face the target work surface simply by operating the MC switch by the operator and the like. That is, the controller 30 can perform front-face control as part of the machine control function. Accordingly, the controller 30 can reduce burden felt by an operator when the upper turning body 3 of the excavator 100 is caused to front-face the target work surface at the start of work on the target work surface by the machine control function, and at the same time, the work efficiency of the excavator 100 can be improved.

Further, in the above-described embodiments and modifications, the controller 30 may suspend the front-face control when the lever device 26C corresponding to the turning movement of the upper turning body 3 is operated, even when the front-face control is being performed. This allows the manual operation by an operator or the like to be prioritized.

Further, in the above-described embodiments and modifications, even when it is determined that there is a front-face deviation in the steps ST1, ST11, and ST12, the controller 30 may be configured so as not to perform front-face control when the front-face deviation is large. Specifically, the automatic control unit 54 may be configured so as not to perform the front-face control when the angle corresponding to the amount of deviation at the time point when it is determined that the front-face deviation is occurring, is greater than a predetermined threshold value. Accordingly, it is possible to prevent a situation in which, even though the operation apparatus 26 is not operated, the amount of the motion of the excavator 100 (the turning amount of the upper turning body 3) by the machine control function is too large and causes anxiety to the operator.

Further, in the above described embodiments and modifications, the controller 30 may operate other actuators instead of the turning hydraulic motor 2A so that the upper turning body 3 is caused to front-face the target work surface. For example, the controller 30 may automatically operate the traveling hydraulic motors 1L and 1R (an example of an actuator) so that the upper turning body 3 is caused to front-face the target work surface. The traveling hydraulic motors 1L and 1R can change the orientation of the upper turning body 3 by rotating in different directions from each other. Specifically, when it is necessary to change the orientation of the upper turning body 3 in the left direction, the controller 30 rotates the traveling hydraulic motor 1R corresponding to the right crawler in the forward direction and rotates the traveling hydraulic motor 1L corresponding to the left crawler in the reverse direction. Accordingly, the excavator 100 can perform neutral turn (i.e., a spin turn) by the lower traveling body 1 and change the orientation of the upper turning body 3 in the left direction so that the excavator 100 can front-face the target work surface.

According to an aspect of the present invention, a technique capable of reducing burden felt by an operator when making the upper turning body of the excavator front-face the target work surface, is provided.

It should be understood that the invention is not limited to the above-described embodiment, but may be modified into various forms on the basis of the spirit of the invention. Additionally, the modifications are included in the scope of the invention.

What is claimed is:

1. An excavator comprising:

a lower traveling body;

an upper turning body turnably mounted to the lower traveling body;

an actuator configured to change an orientation of the upper turning body; and a control apparatus configured to perform front-face control to operate the actuator such that the upper turning body is caused to front-face a target surface, based on information regarding the target surface and information regarding the orientation of the upper turning body, wherein the control apparatus performs the front-face control such that the upper turning body maintains a state of front-facing the target surface, while the lower traveling body moves along a direction in which the target surface extends.

2. The excavator according to claim 1, further comprising:

a pair of traveling motors configured to drive the lower traveling body, wherein the control apparatus performs the front-face control such that the upper turning body maintains the state of front-facing the target surface, while the lower traveling body is driven by at least one traveling motor of the pair of traveling motors to move along the direction in which the target surface extends.

3. The excavator according to claim 1, further comprising:

an attachment mounted to the upper turning body, wherein the front-face control is performed such that the upper turning body maintains the state of front-facing the target surface, when the attachment is being driven.

4. The excavator according to claim 1, wherein the actuator configured to change the orientation of the upper turning body is a turning driving unit configured to drive the upper turning body.

5. The excavator according to claim 1, wherein the actuator configured to change the orientation of the upper turning body is a traveling motor.

6. The excavator according to claim 1, further comprising:

a spatial recognition device configured to recognize a surrounding condition of the excavator, wherein before the actuator starts operating, the control apparatus disables the actuator from operating, upon determining that there is a person present within a predetermined range from the excavator based on information acquired by the spatial recognition device.

7. The excavator according to claim 1, further comprising:

a spatial recognition device configured to recognize a surrounding condition of the excavator; and an operation apparatus configured to receive an operation with respect to the actuator, wherein before the actuator starts operating, the control apparatus does not drive the actuator even when the operation apparatus is operated, upon determining that there is a person present within a predetermined range from the excavator based on information acquired by the spatial recognition device.

8. An excavator comprising:

a lower traveling body;

an upper turning body turnably mounted to the lower traveling body;

an attachment to be attached to the upper turning body;

an actuator configured to change an orientation of the upper turning body; and a control apparatus configured to perform front-face control to operate the actuator such that the upper turning body is caused to front-face a target surface, based on information regarding the target surface and information regarding the orientation of the upper turning body, wherein the control apparatus starts performing the front-face control in response to the upper turning body being operated to turn in a direction such that the attachment comes near the target surface, and performs the front-face control such that the upper turning body maintains a state of front-facing the target surface, while the lower traveling body moves along a direction in which the target surface extends.

9. A control apparatus of an excavator, the excavator including a lower traveling body; an upper turning body turnably mounted to the lower traveling body; and an actuator configured to change an orientation of the upper turning body, wherein the control apparatus is configured to perform front-face control to operate the actuator such that the upper turning body is caused to front-face a target surface, based on information regarding the target surface and information regarding the orientation of the upper turning body, and to perform the front-face control such that the upper turning body maintains a state of front-facing the target surface, while the lower traveling body moves along a direction in which the target surface extends.

10. A control apparatus of an excavator, the excavator including a lower traveling body; an upper turning body turnably mounted to the lower traveling body; an attachment to be attached to the upper turning body; and an actuator configured to change an orientation of the upper turning body, wherein the control apparatus is configured to perform front-face control to operate the actuator such that the upper turning body is caused to front-face a target surface, based on information regarding the target surface and information regarding the orientation of the upper turning body, to start performing the front-face control in response to the upper turning body being operated to turn in a direction such that the attachment comes near the target surface, and to perform the front-face control such that the upper turning body maintains a state of front-facing the target surface, while the lower traveling body moves along a direction in which the target surface extends.

11. The control apparatus of the excavator according to claim 9, wherein the front-face control is performed such that the upper turning body maintains the state of front-facing the target surface, while the lower traveling body is driven by at least one travelling motor of a pair of travelling motors configured to drive the lower traveling body to move along the direction in which the target surface extends.

12. The control apparatus of the excavator according to claim 9, wherein the front-face control is performed such that the upper turning body maintains the state of front-facing the target surface, when an attachment mounted to the upper turning body is being driven.

13. The control apparatus of the excavator according to claim 9, wherein the actuator configured to change the orientation of the upper turning body is a turning driving unit configured to drive the upper turning body.

14. The control apparatus of the excavator according to claim 9, wherein the actuator configured to change the orientation of the upper turning body is a traveling motor.

15. The control apparatus of the excavator according to claim 9, wherein before the actuator starts operating, the control apparatus disables the actuator from operating, upon determining that there is a person present within a predetermined range from the excavator based on information acquired by a spatial recognition device configured to recognize a surrounding condition of the excavator.

* * * * *